US011485563B2

(12) United States Patent
Kato

(10) Patent No.: US 11,485,563 B2
(45) Date of Patent: Nov. 1, 2022

(54) PACKAGING BAG

(71) Applicant: DAIO PAPER CORPORATION, Shikokuchuo (JP)

(72) Inventor: Hirohiko Kato, Fujinomiya (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 16/977,545

(22) PCT Filed: Nov. 29, 2018

(86) PCT No.: PCT/JP2018/044044
§ 371 (c)(1),
(2) Date: Sep. 2, 2020

(87) PCT Pub. No.: WO2019/187344
PCT Pub. Date: Oct. 3, 2019

(65) Prior Publication Data

US 2021/0002052 A1 Jan. 7, 2021

(30) Foreign Application Priority Data

Mar. 28, 2018 (JP) ..... 2018-061348

(51) Int. Cl.
*B65D 77/30* (2006.01)

(52) U.S. Cl.
CPC ..... *B65D 77/30* (2013.01)

(58) Field of Classification Search
CPC ..... B65D 77/30
(Continued)

(56) References Cited

U.S. PATENT DOCUMENTS 3,460,671 A * 8/1969 Harm ..... B65D 71/08 206/391
6,318,625 B1 11/2001 Muller et al.
(Continued)

FOREIGN PATENT DOCUMENTS

EP 1405802 A1 4/2004
JP H3-100139 U 10/1991
(Continued)

OTHER PUBLICATIONS

Office Action dated Jun. 6, 2019 in corresponding Japanese Application No. 2018-061348; 6 pages including English-language translation.

(Continued)

*Primary Examiner* — Jacob K Ackun
(74) *Attorney, Agent, or Firm* — Maier & Maier, PLLC

(57) ABSTRACT

A packaging bag with a body for storing a plurality of articles to be packaged, wherein the body has a top surface part, a bottom surface part that opposes the top surface part in the vertical direction, and a plurality of lateral surface parts that are arranged between the top surface part and the bottom surface part; a slash part for opening is provided to at least one of the plurality of lateral surface parts; and the slash part has a first slit that extends from near the top surface part to near the bottom surface part in the vertical direction, and a second slit that is contiguous to one end of the first slit on the top surface part side and that extends in the traverse direction intersecting the vertical direction.

18 Claims, 20 Drawing Sheets

(58) Field of Classification Search
USPC ..... 206/410
See application file for complete search history.

(56) References Cited

U.S. PATENT DOCUMENTS

| | | | | |
|---|---|---|---|---|
| 2005/0276525 | A1 | 12/2005 | Hebert et al. | |
| 2006/0124494 | A1 | 6/2006 | Clark, Jr. et al. | |
| 2019/0336362 | A1* | 11/2019 | Miyama ..... | B65D 75/5833 |

FOREIGN PATENT DOCUMENTS

| | | | |
|---|---|---|---|
| JP | H0665241 | U | 9/1994 |
| JP | 2003-104449 | A | 4/2003 |
| JP | 2009-202931 | A | 9/2009 |
| JP | 2011-73754 | A | 4/2011 |
| JP | 2012-121592 | A | 6/2012 |
| JP | 2015-067328 | A | 4/2015 |

OTHER PUBLICATIONS

Office Action dated Dec. 27, 2018 in corresponding Japanese Application No. 2018-061348; 8 pages including English-language translation.

Office Action dated Mar. 16, 2020 in corresponding Japanese Application No. 2018-061348; 14 pages including English-language translation.

Chinese Office Action dated Aug. 24, 2021, in connection with corresponding CN Application No. 201880088665.9 (13 pp., including machine-generated English translation).

Extended European Search Report dated Apr. 13, 2021 of corresponding European application No. 18911554; 7 pgs.

Translation of International Search Report dated Jan. 15, 2019 and Written Opinion of corresponding application Mo. PCT/JP2018/044044; 10 pgs.

Office Action dated Aug. 5, 2022 in corresponding European Application No. 18911554.6, 4 pages.

* cited by examiner

[FIG. 1]
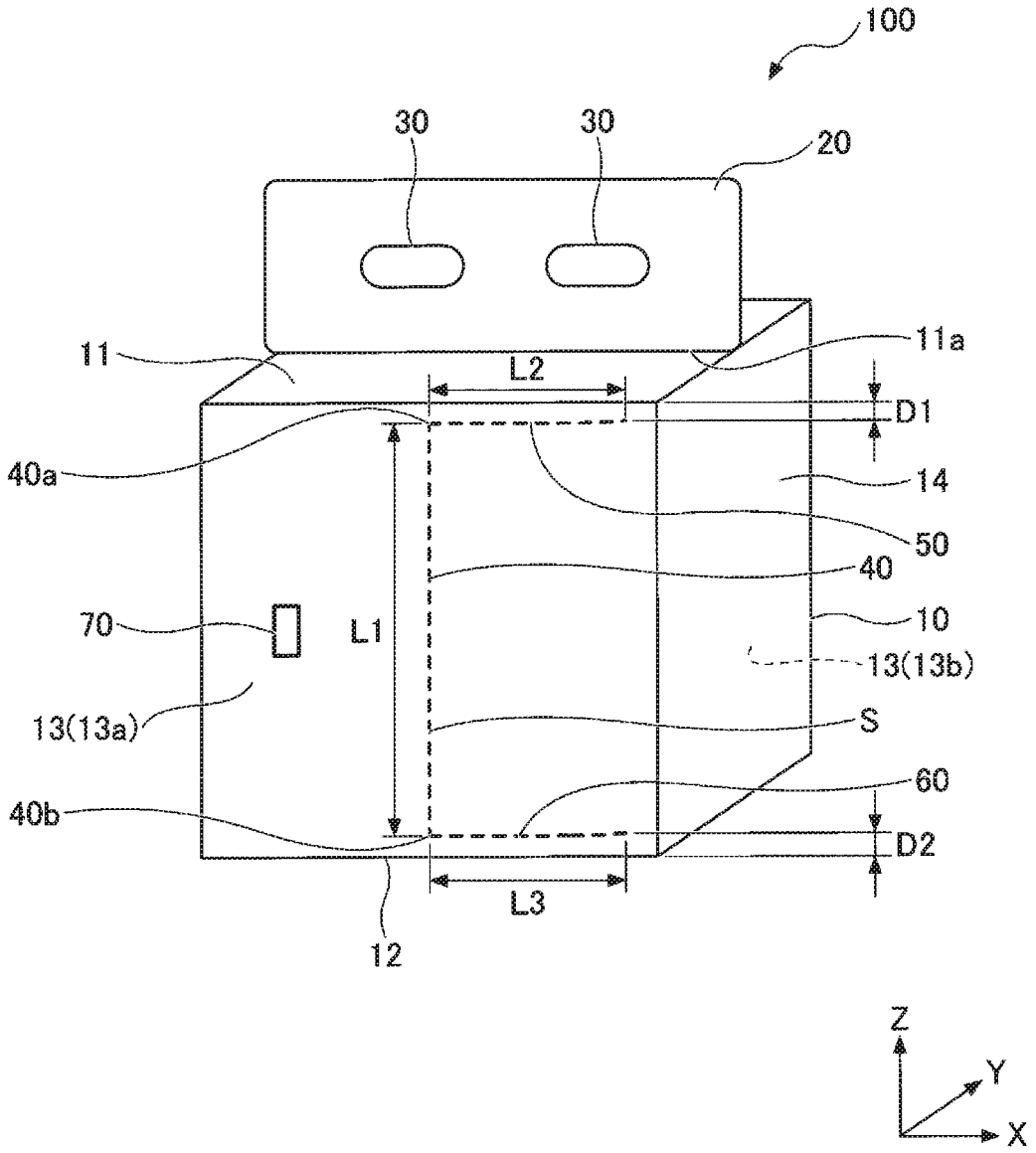

[FIG. 2]
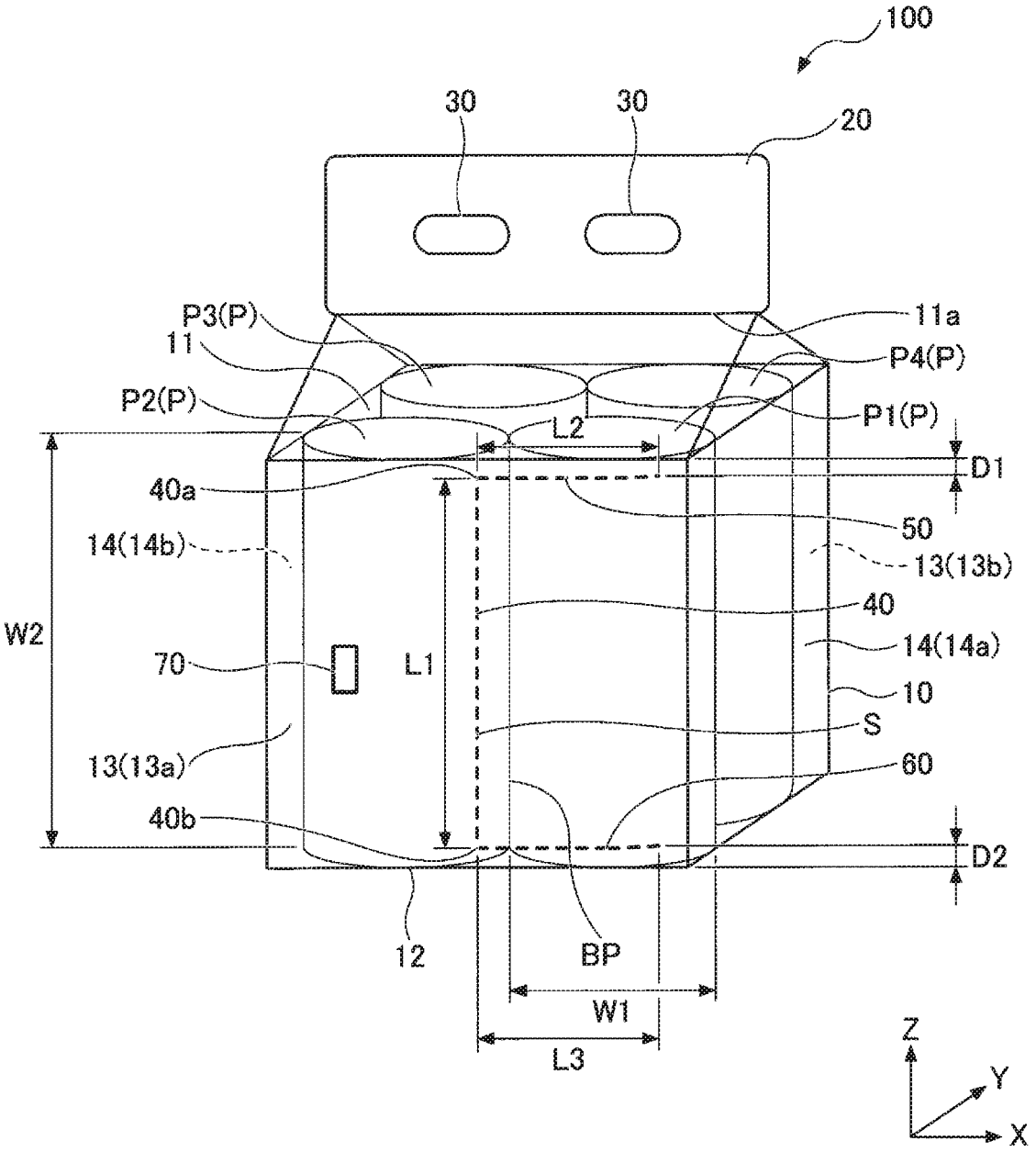

[FIG. 3]
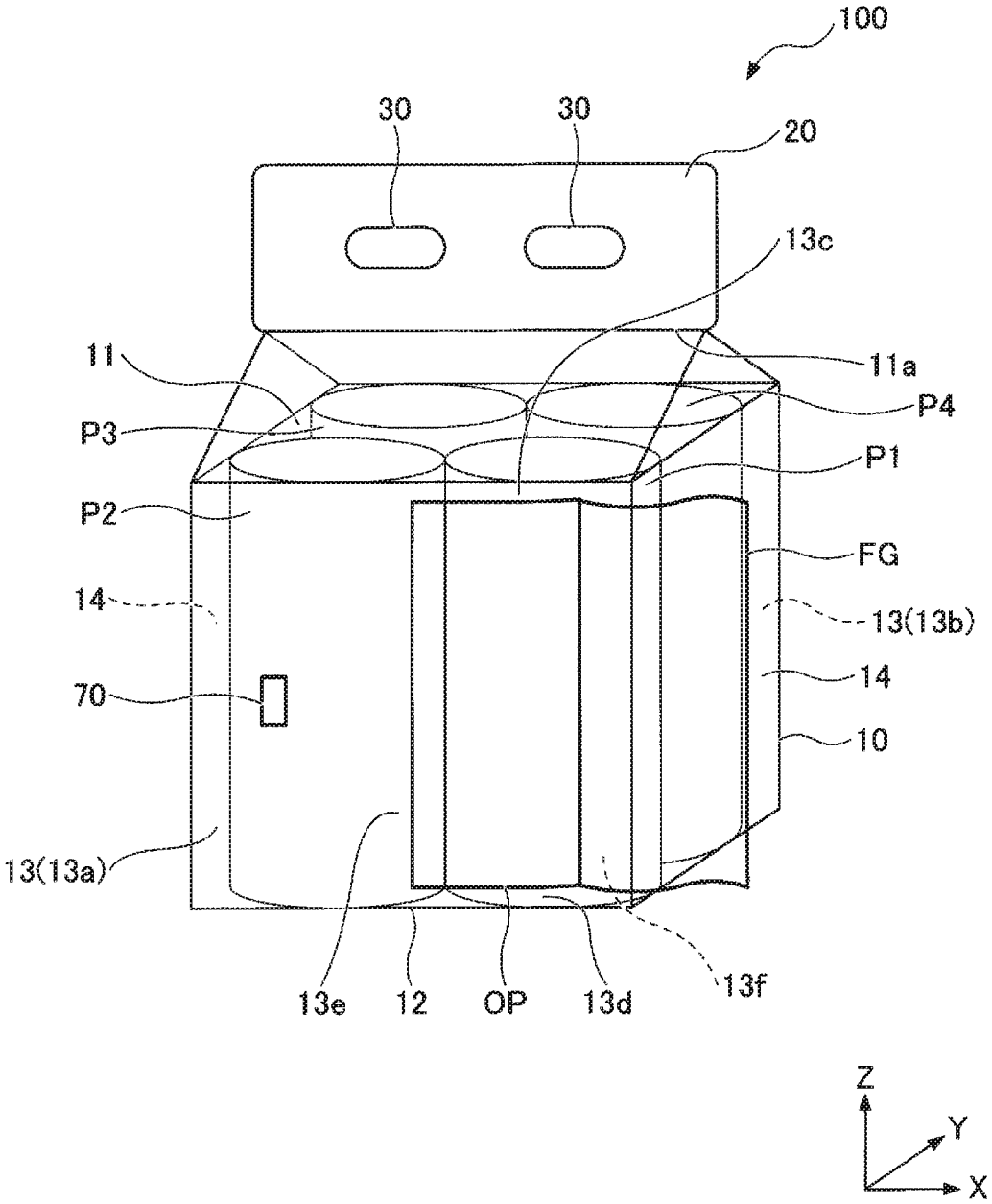

[FIG. 4]
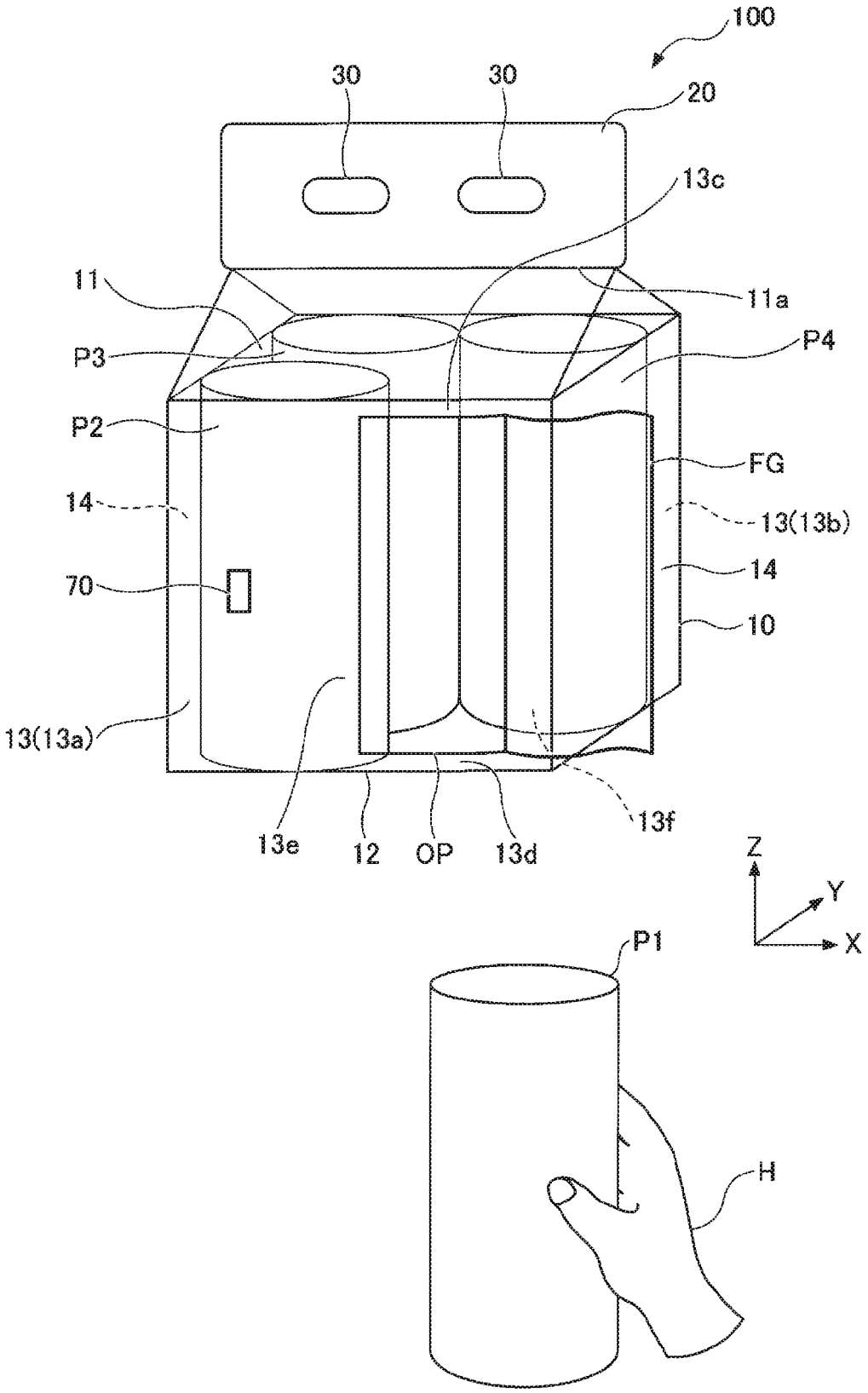

[FIG. 5]
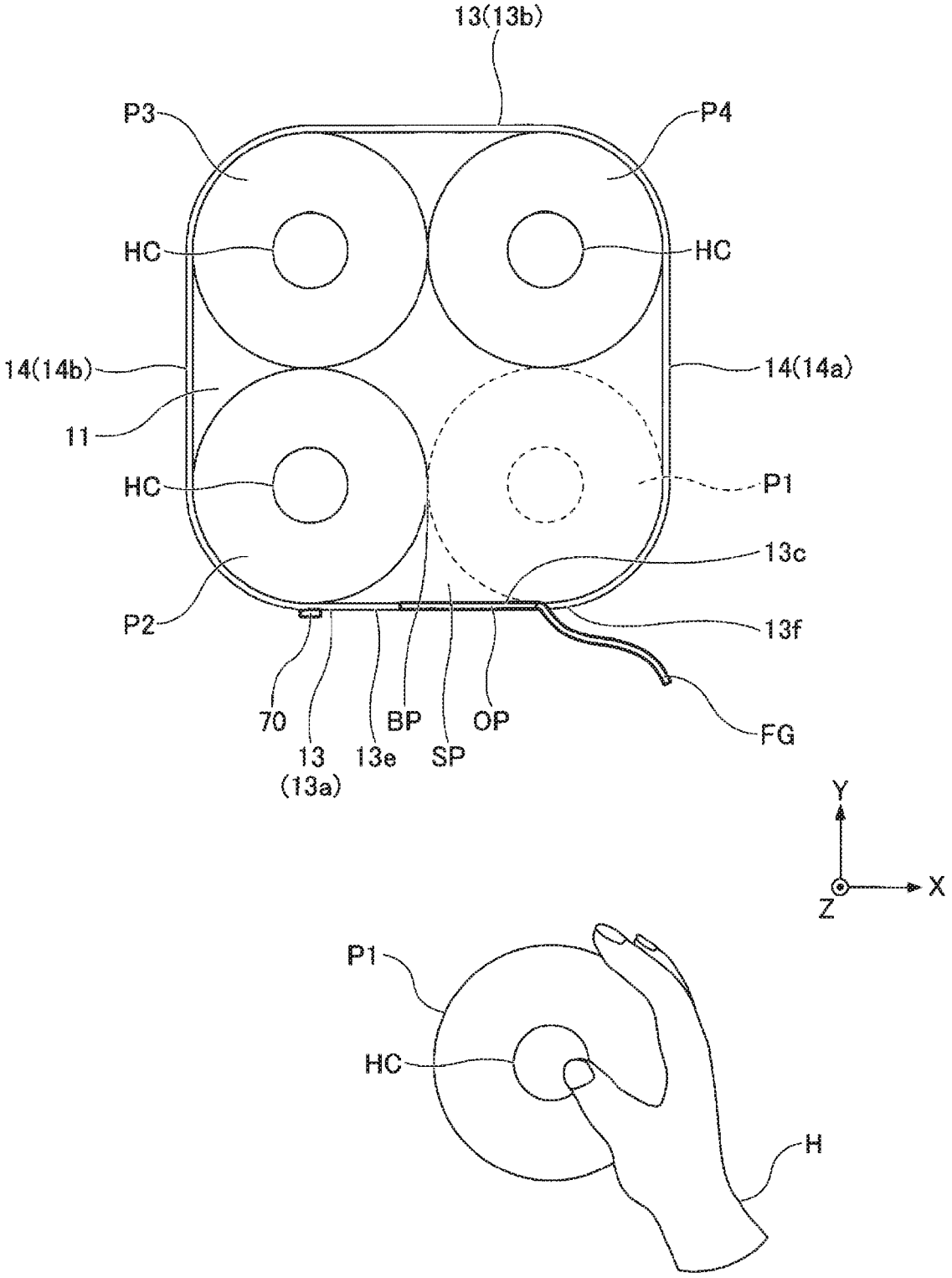

[FIG. 6]
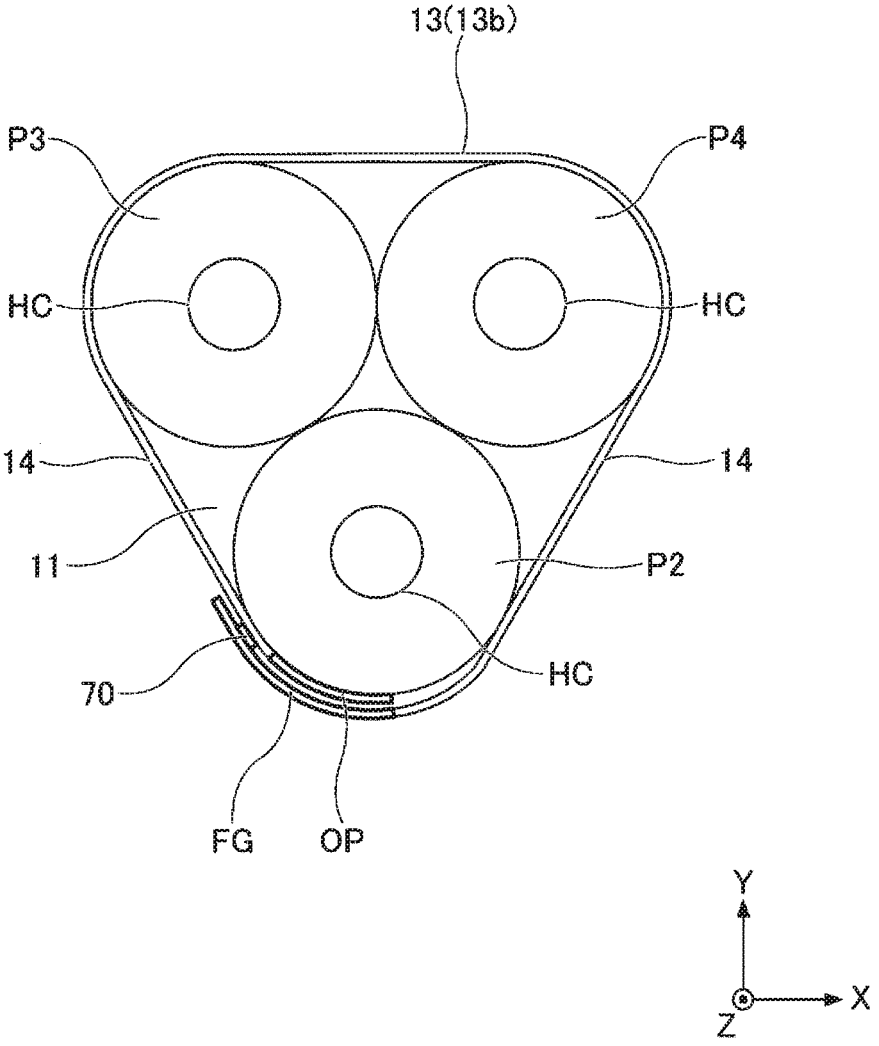

[FIG. 7]
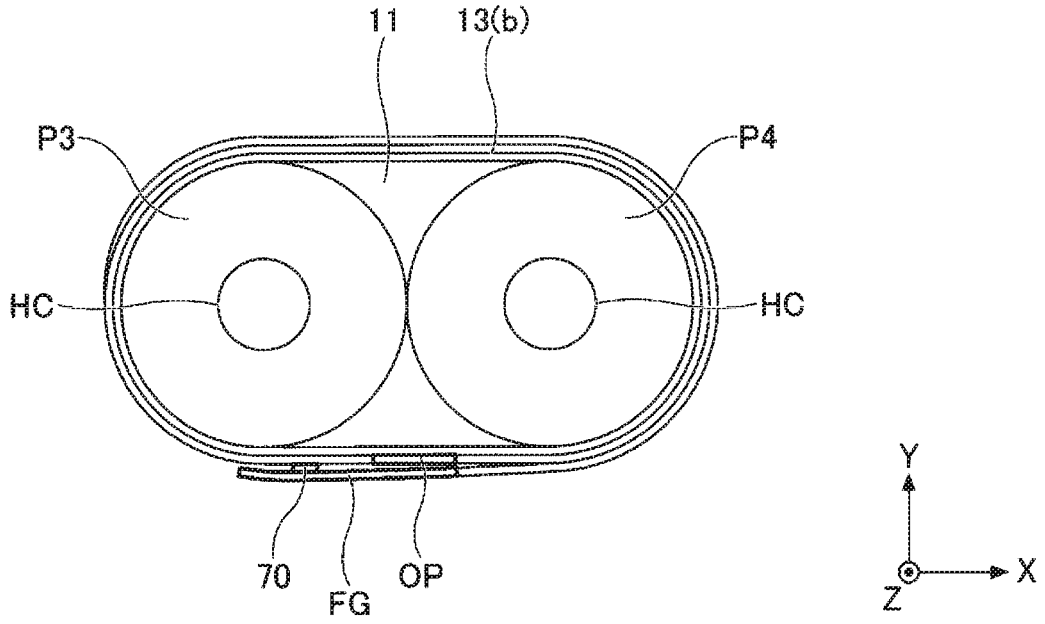
[FIG. 8]
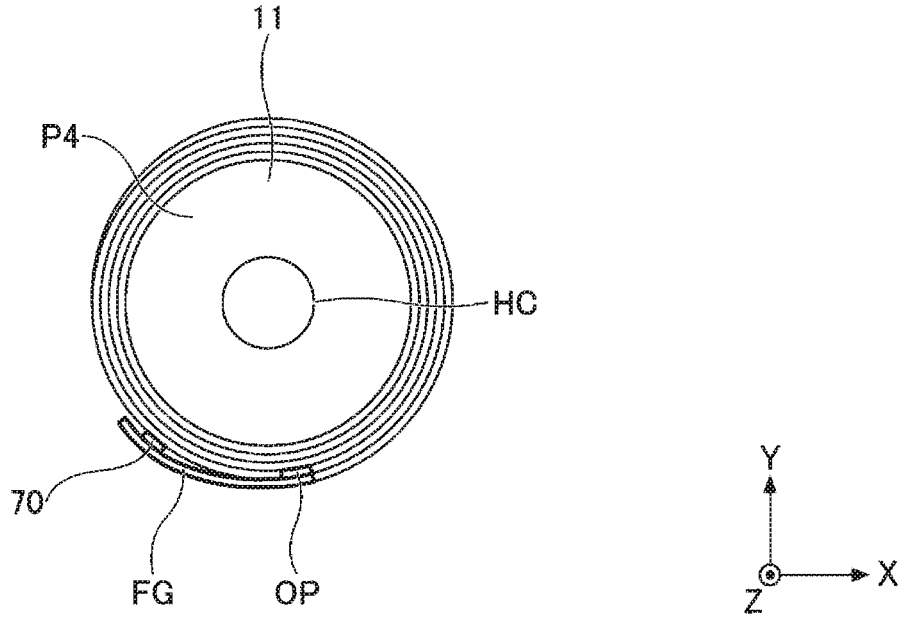

[FIG. 9]
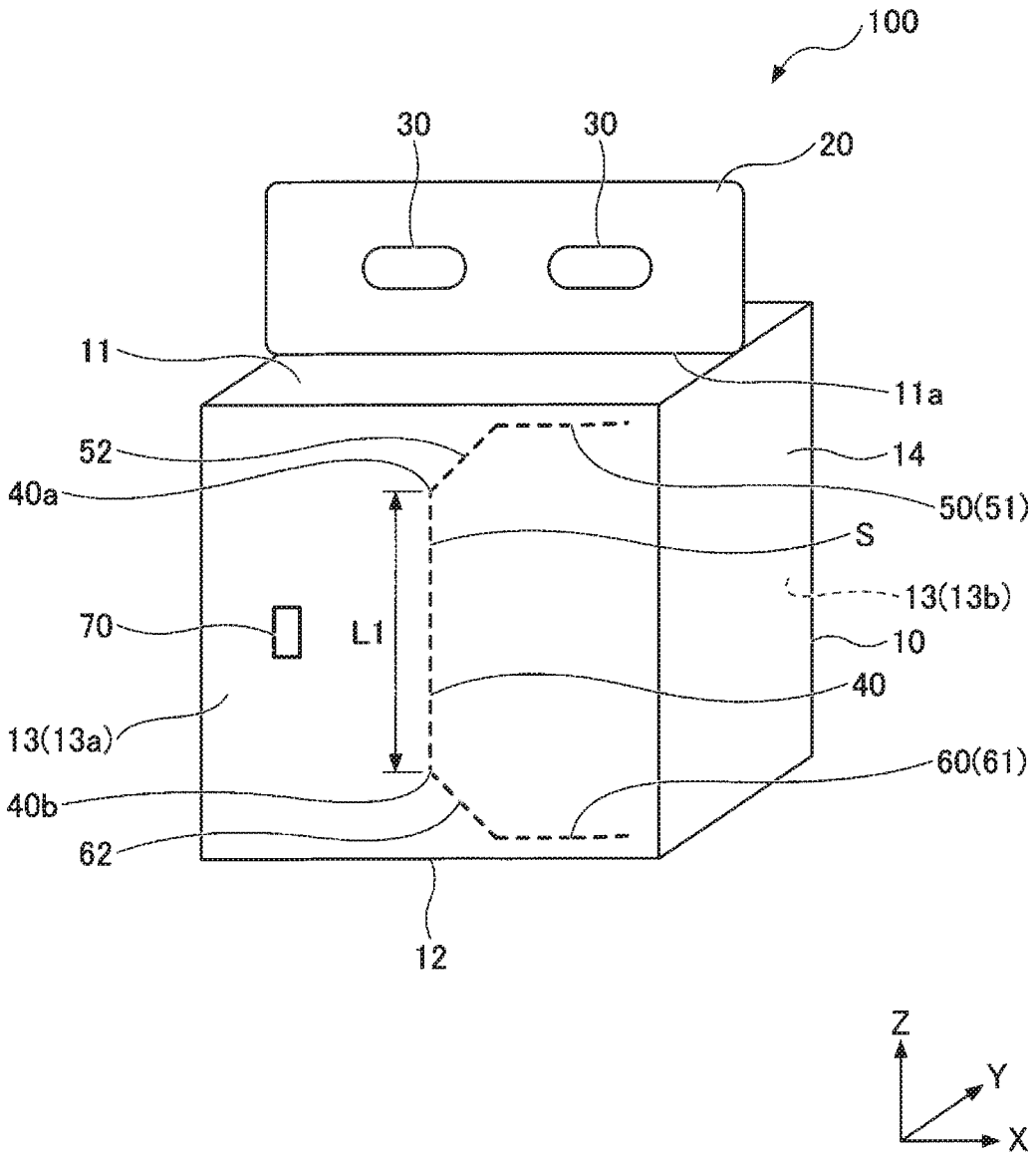

[FIG. 10]
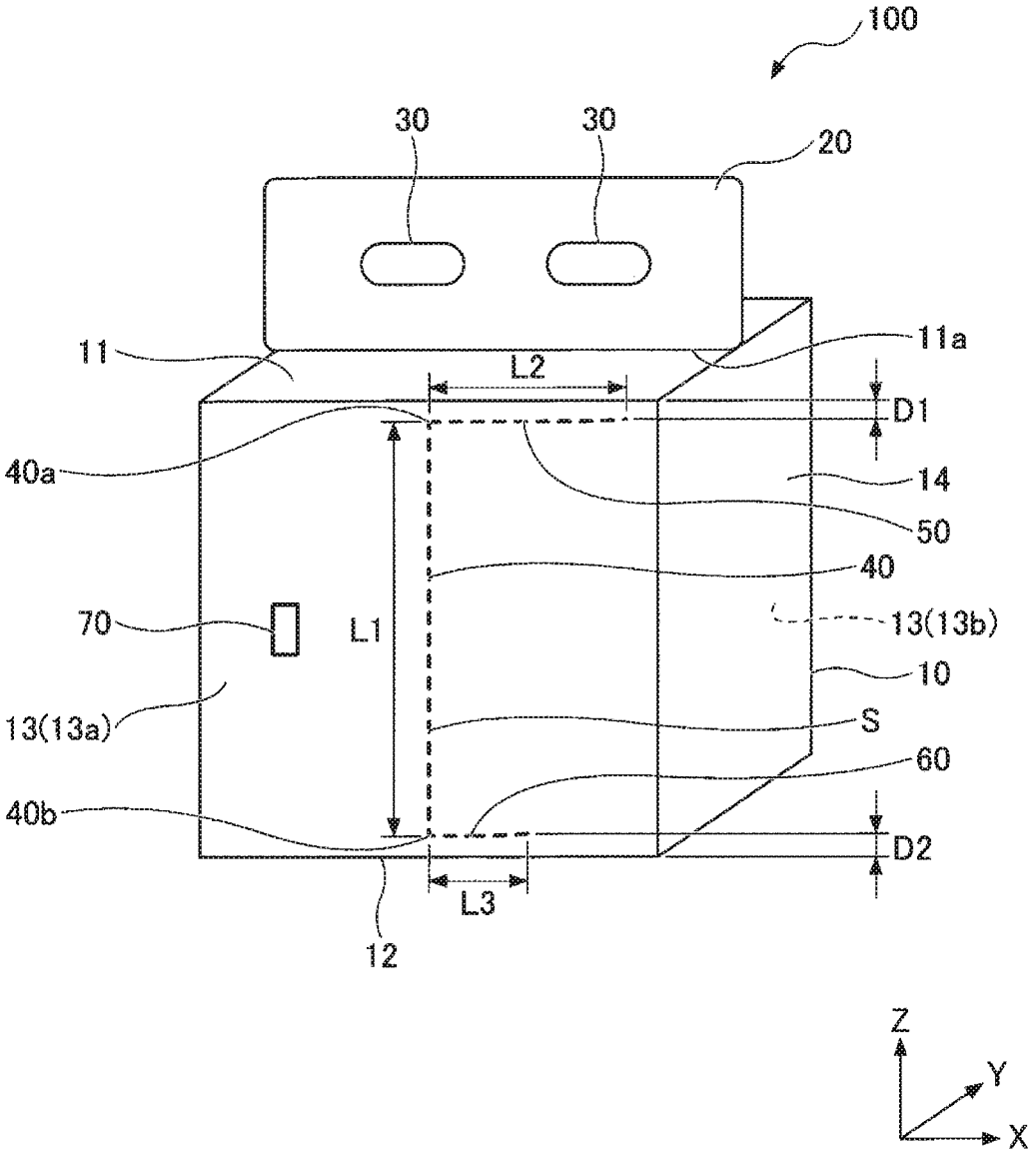

[FIG. 11]
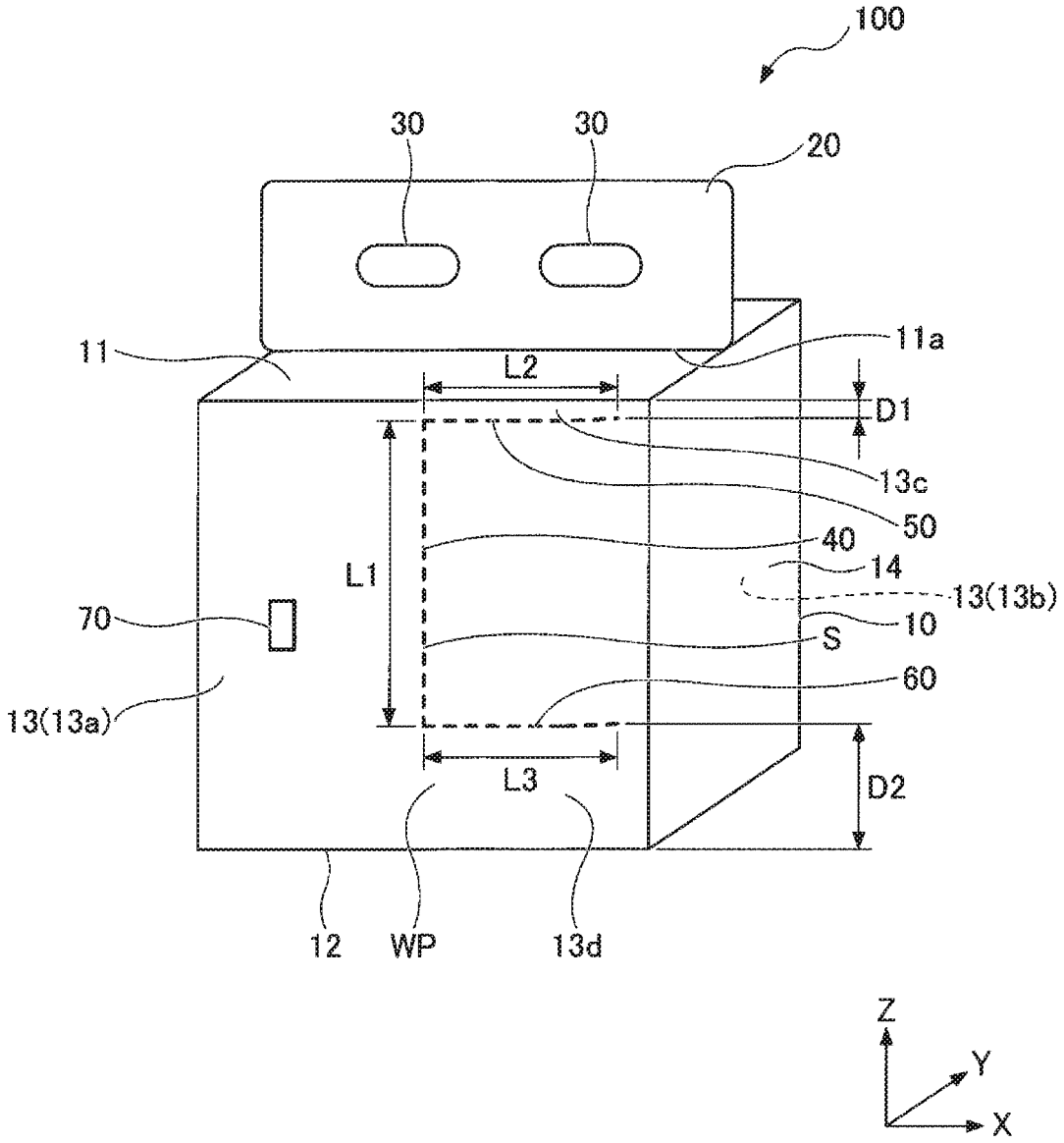

[FIG. 12]
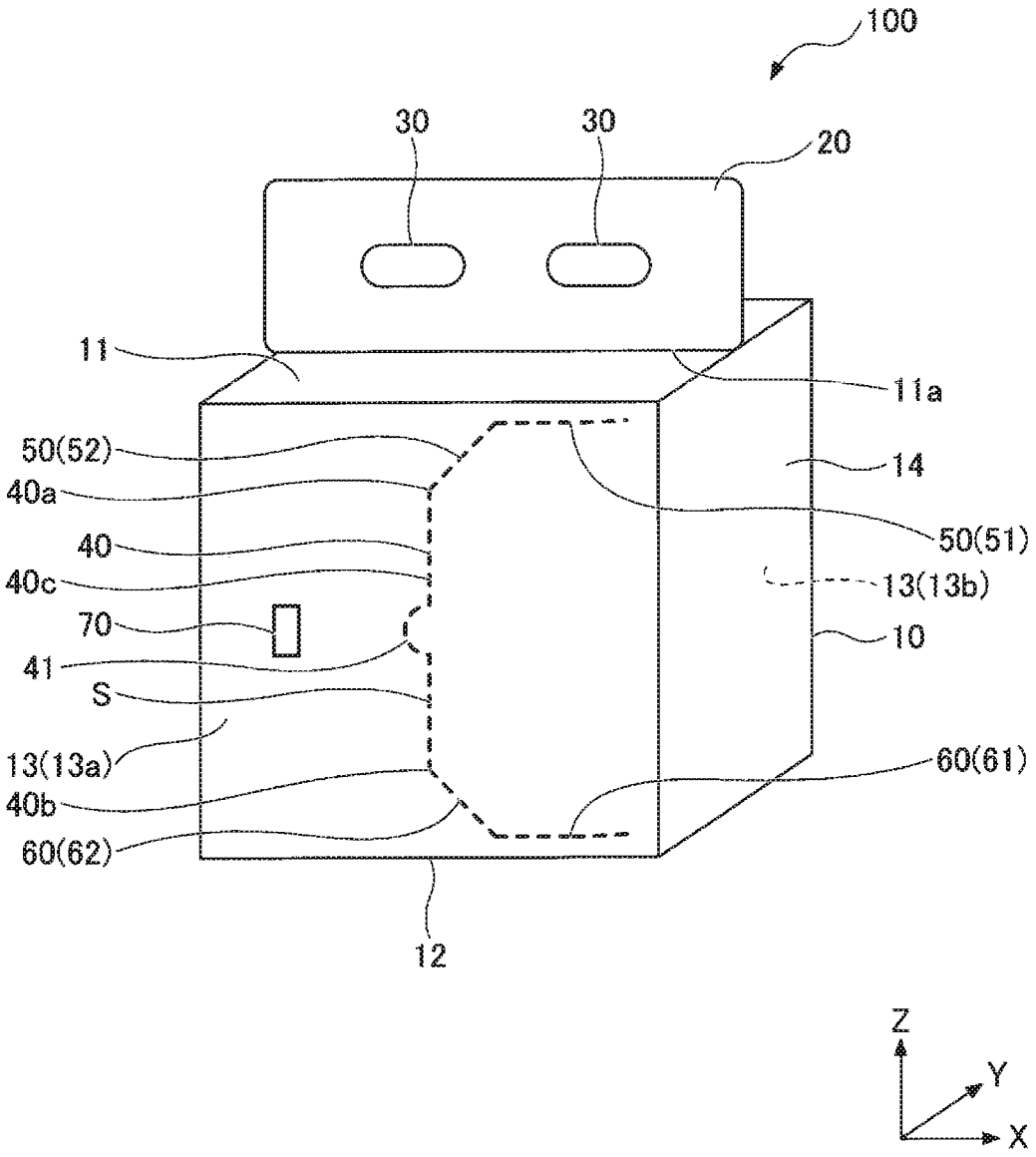

[FIG. 13]
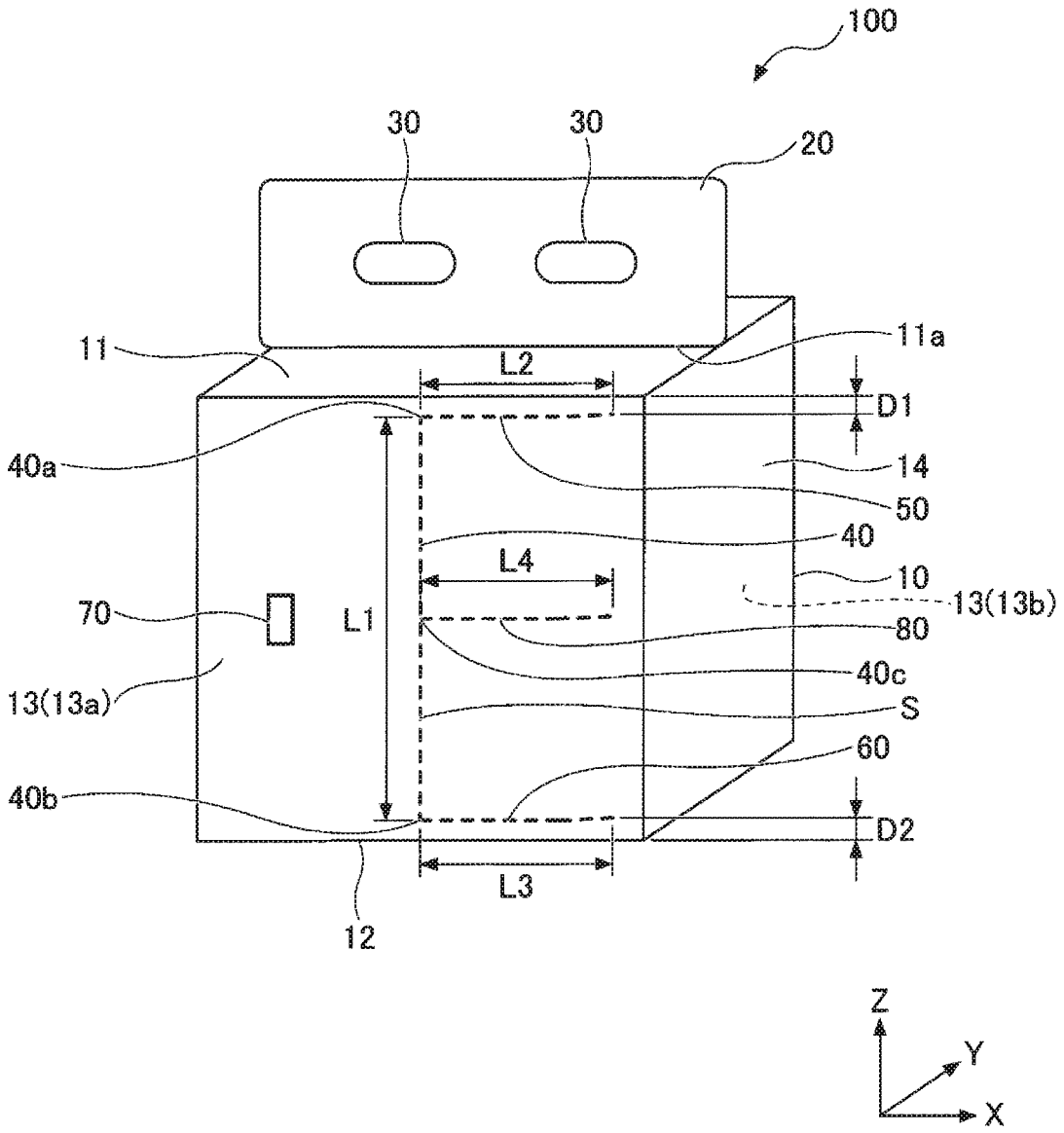

[FIG. 14]
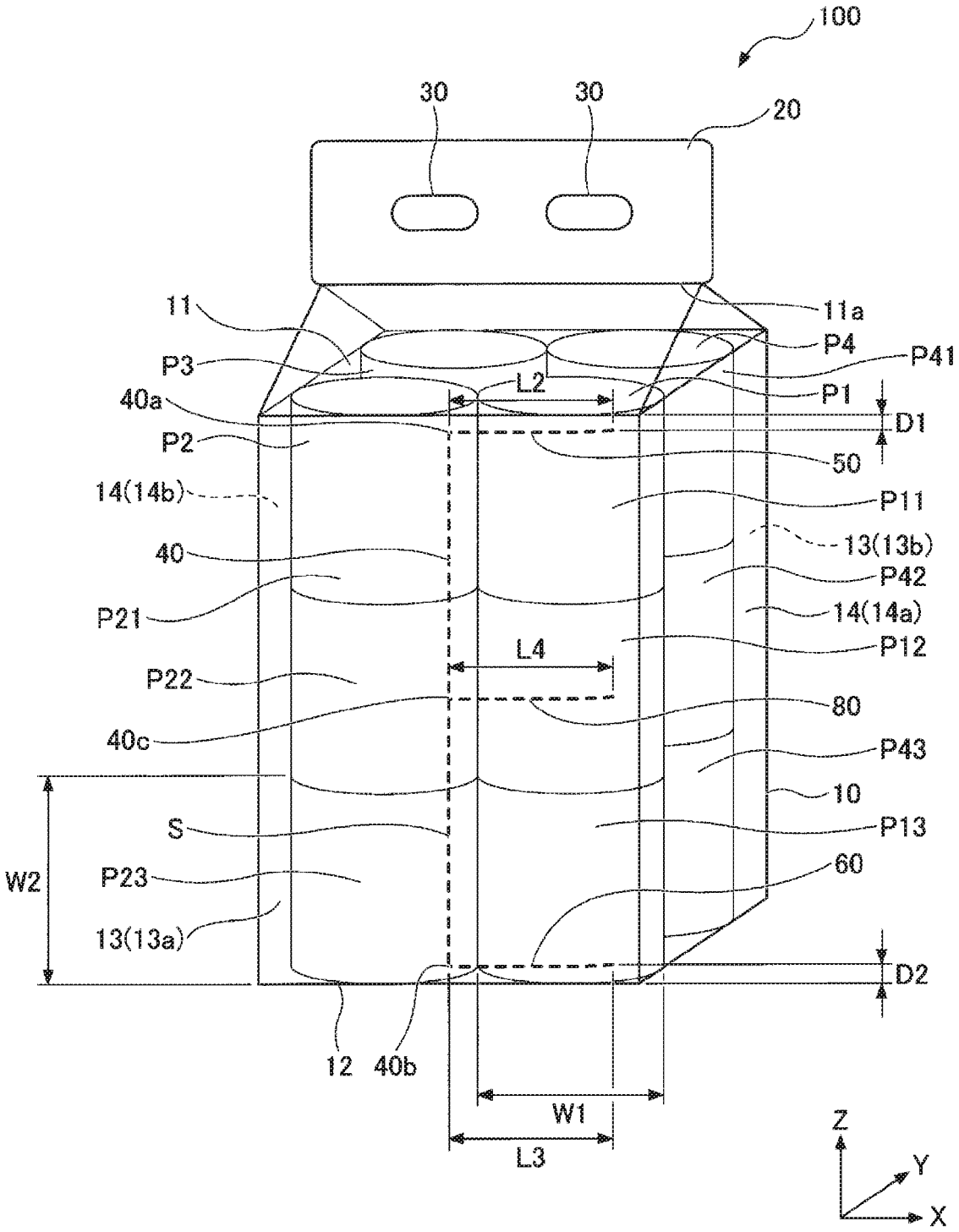

[FIG. 15]
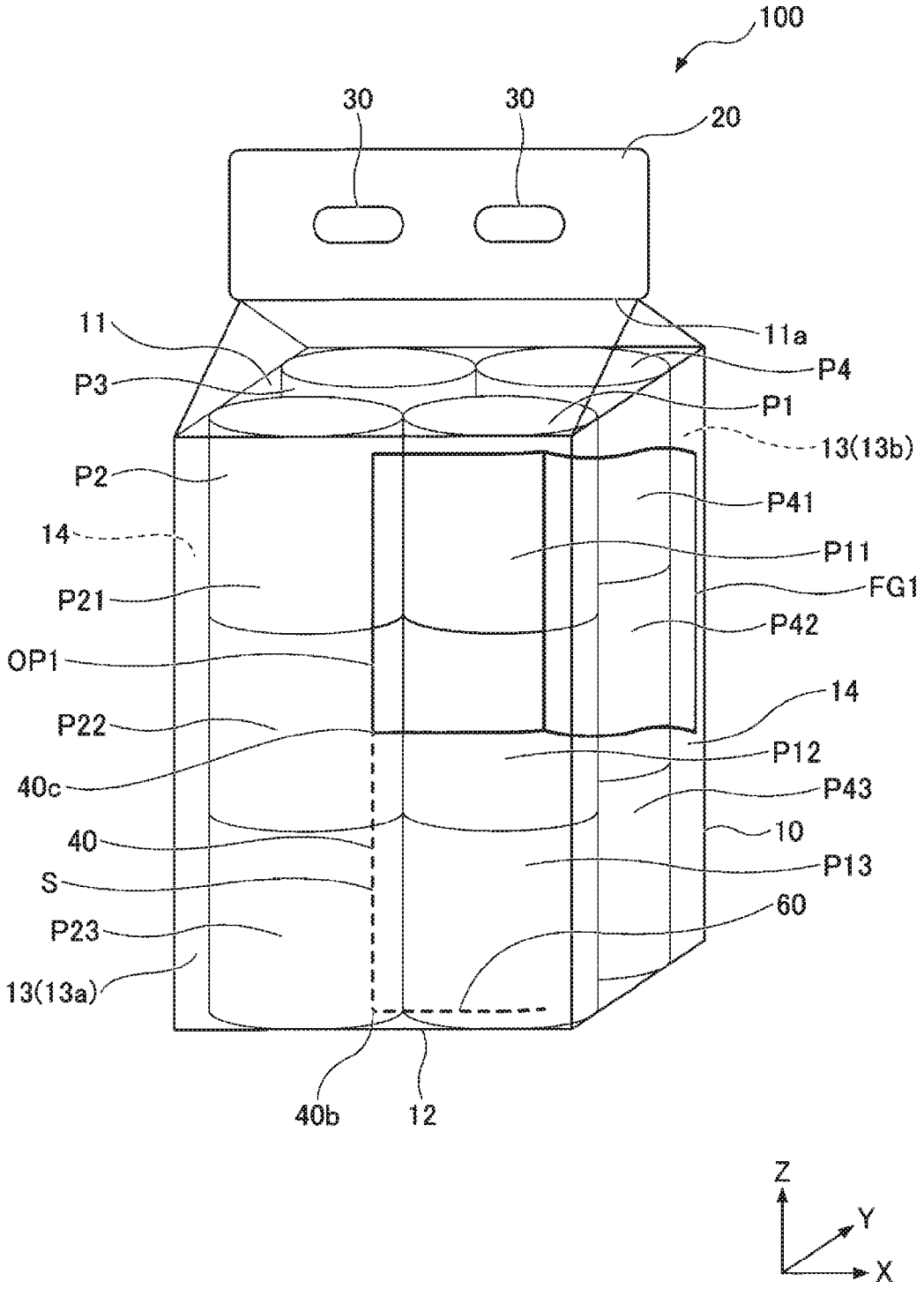

[FIG. 16]
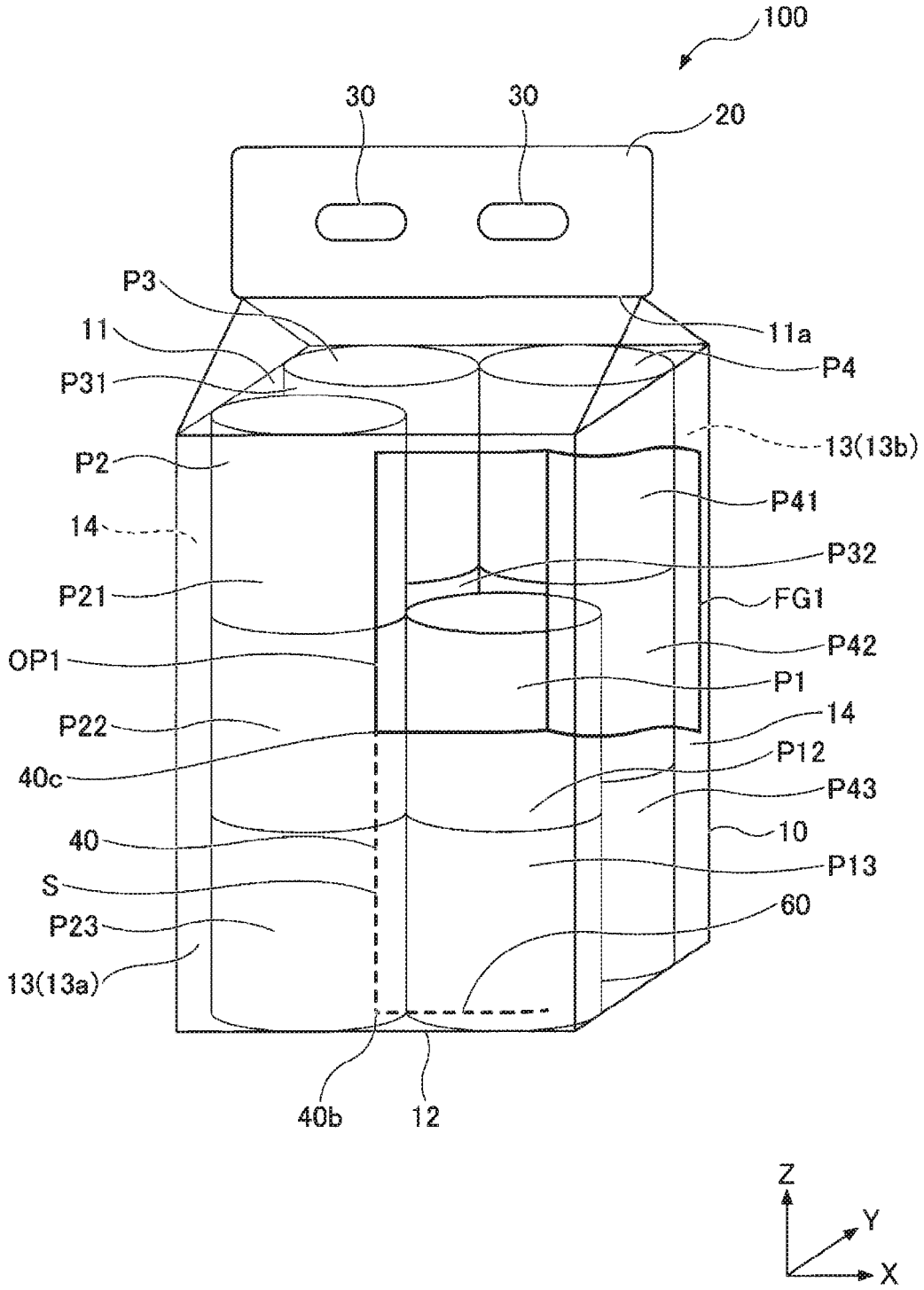

[FIG. 17]
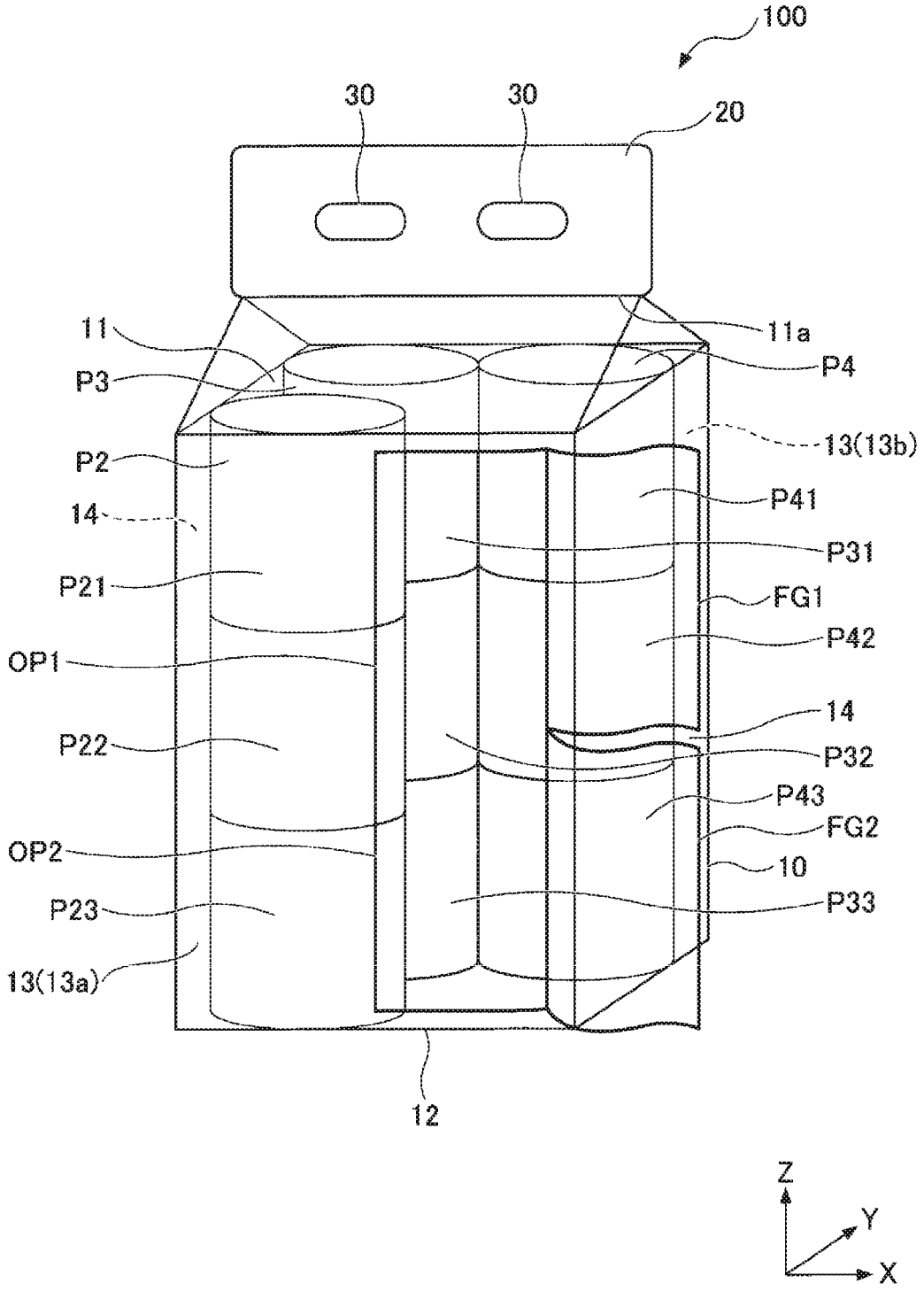

[FIG. 18]
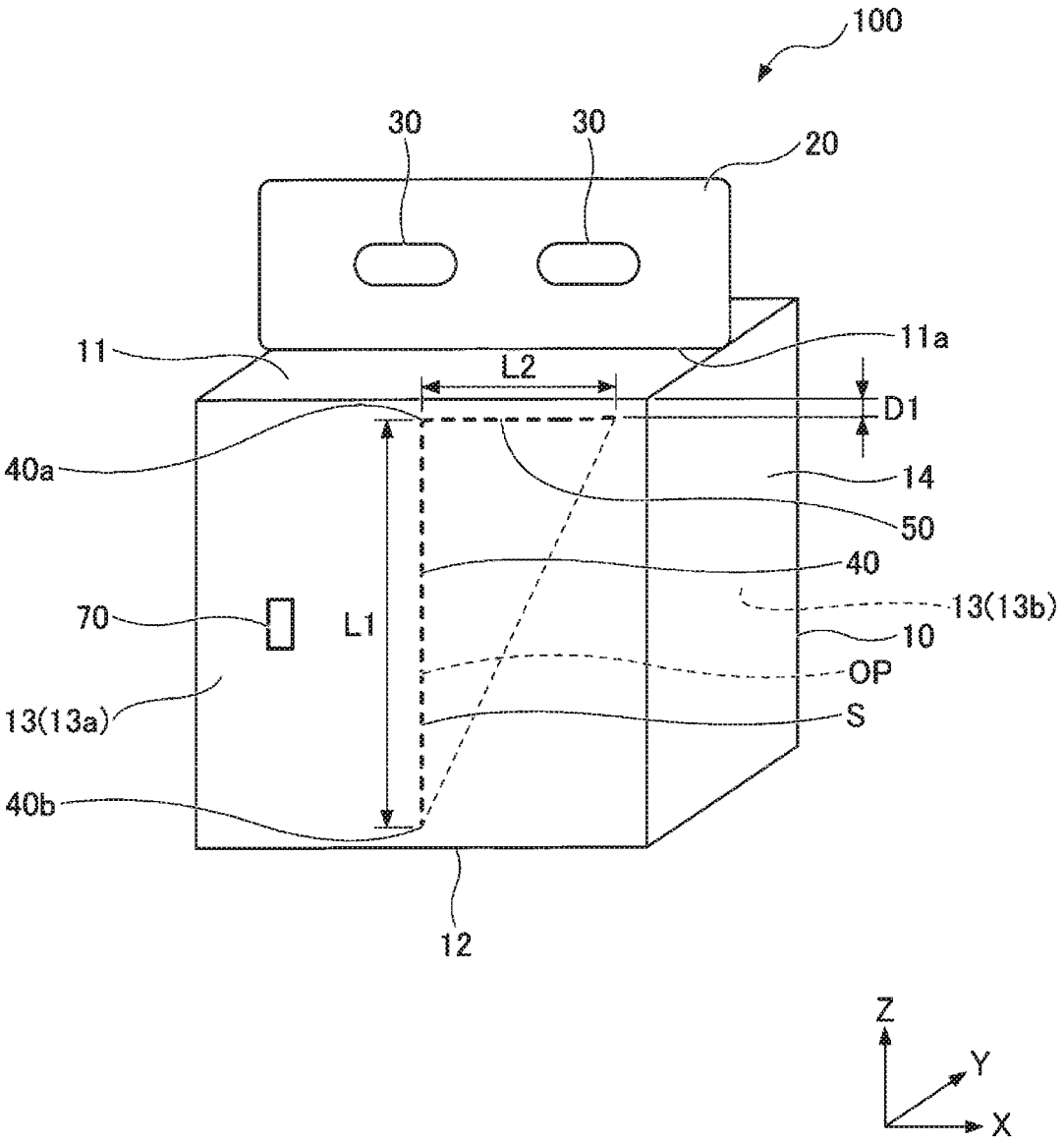

[FIG. 19]
(prior art)
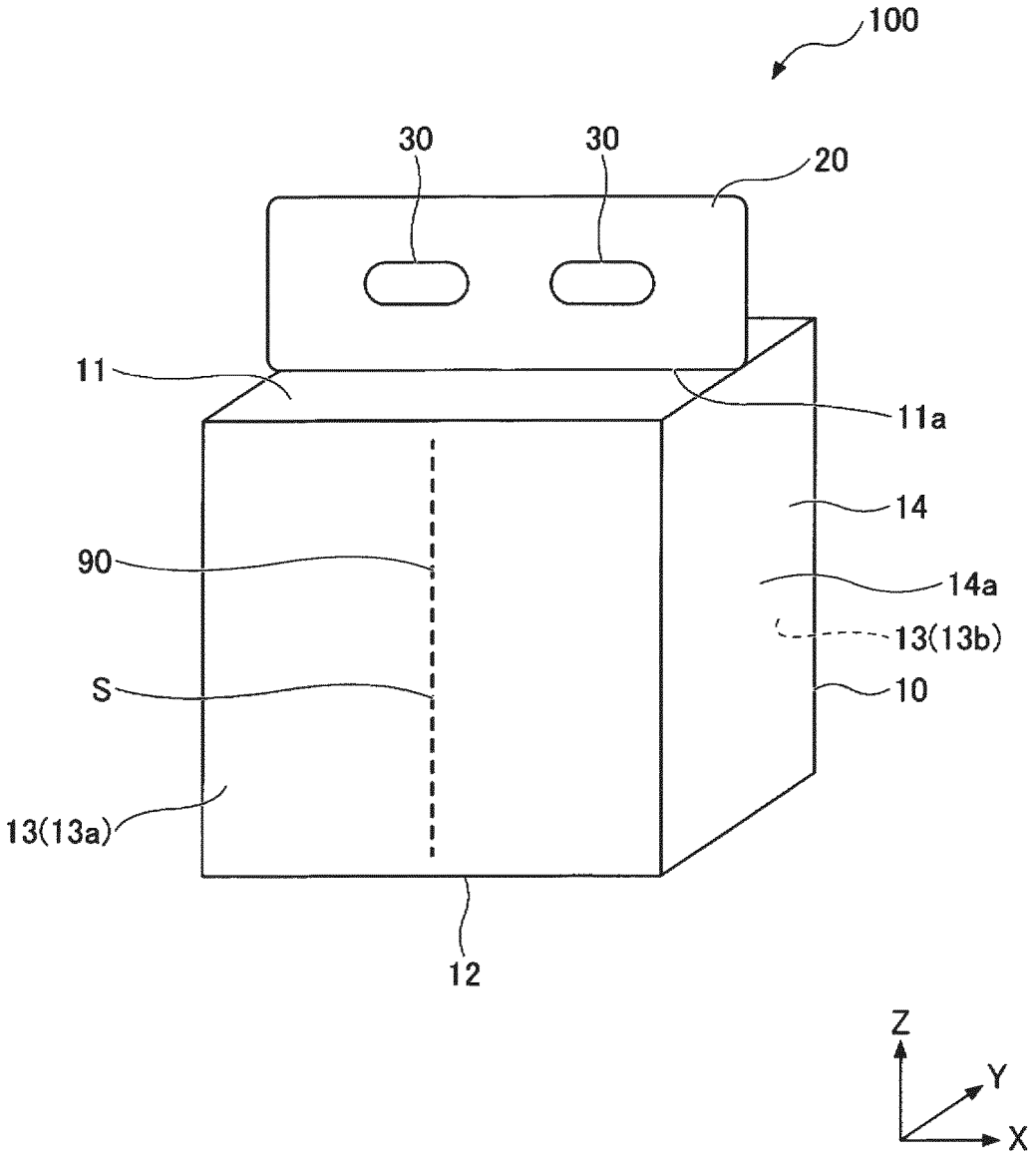

[FIG. 20]
(prior art)
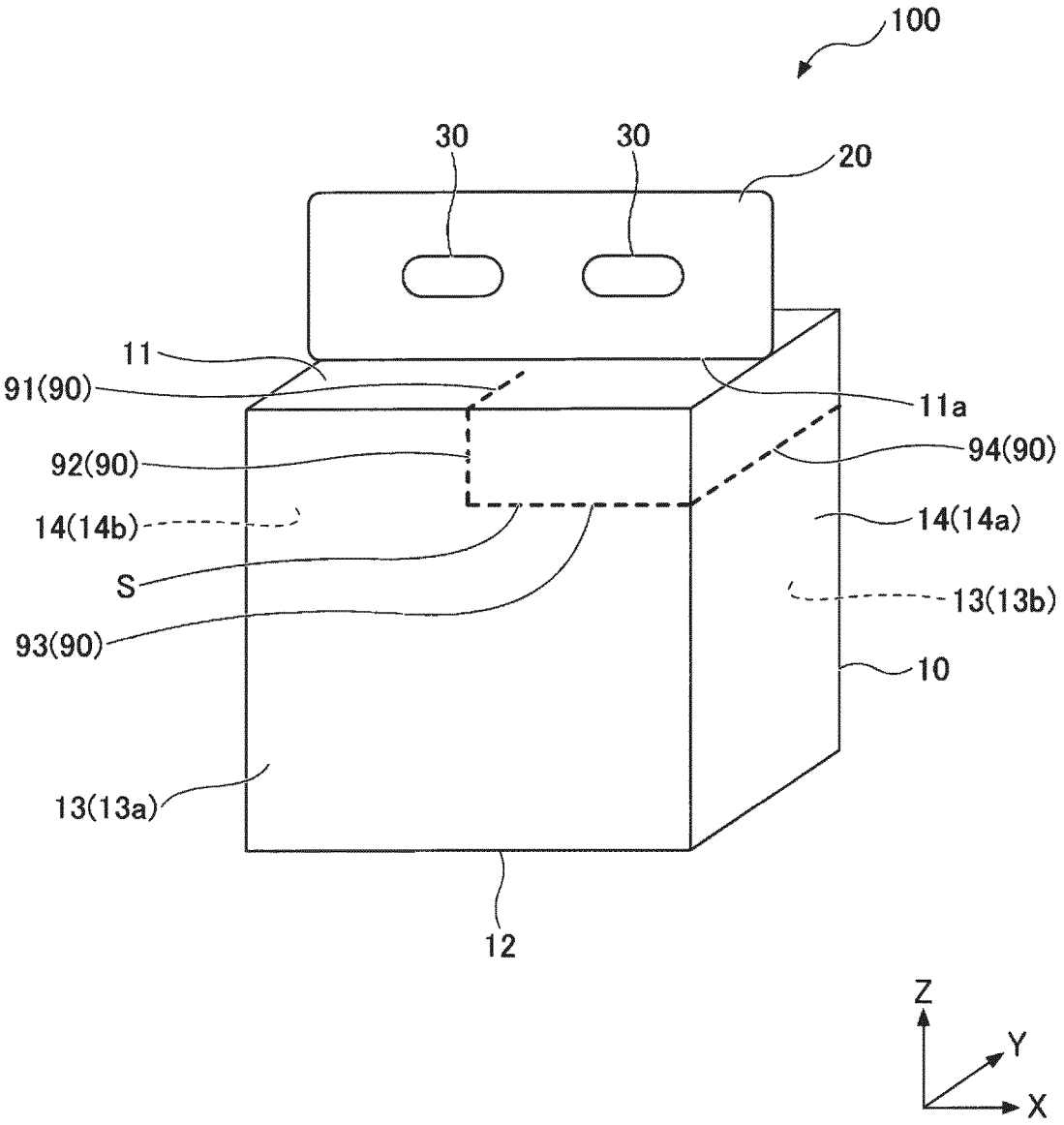

[FIG. 21]
(prior art)
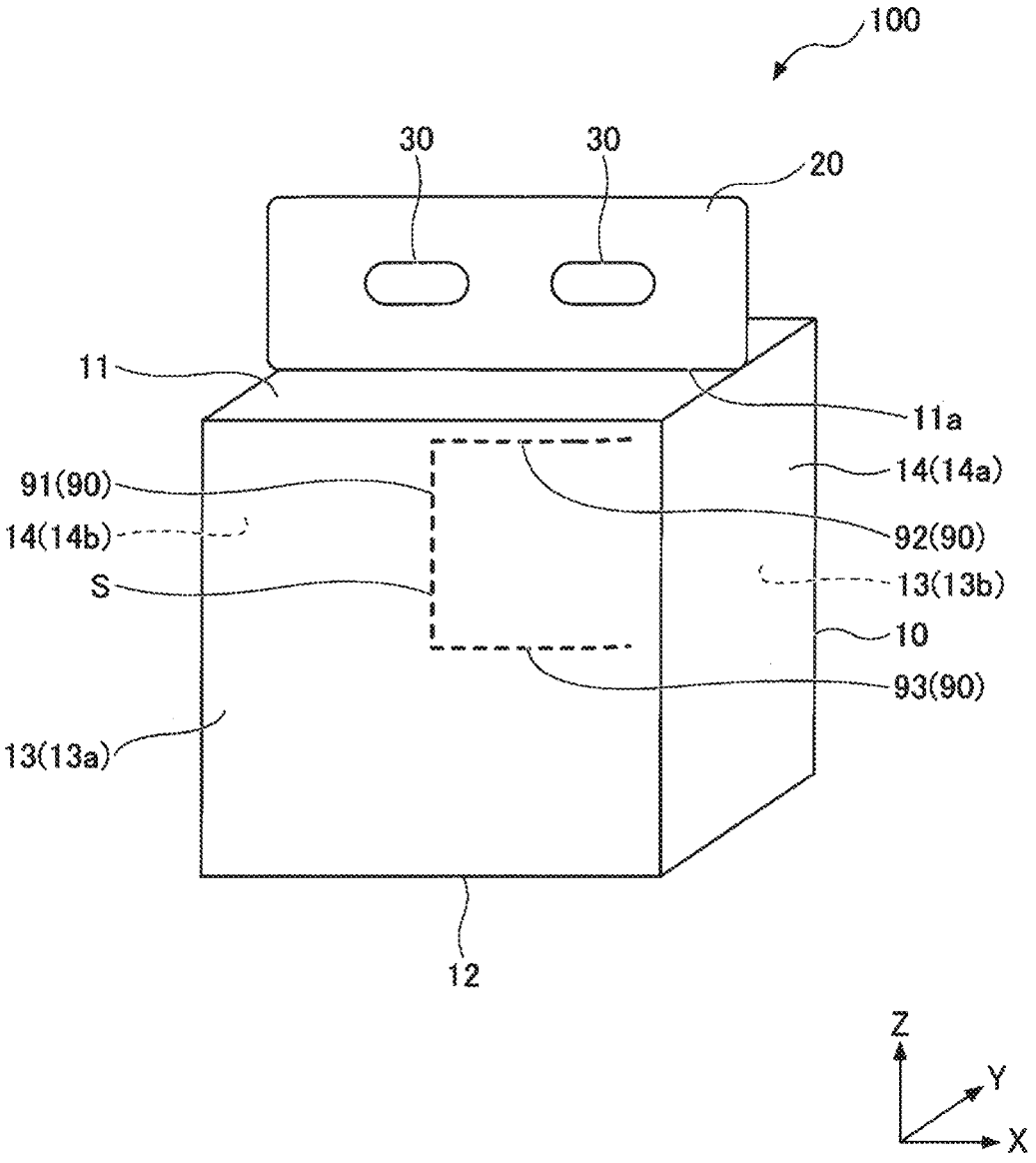

PACKAGING BAG

FIELD

The present invention relates to a packaging bag.

BACKGROUND

In recent years, there is a tendency that daily necessities which can be used for a long period of time and have a high accommodating property and stocking property are favored due to changes in lifestyles of consumers. For sanitary thin paper such as a kitchen towel, a lot of long length products in which a roll length of a roll is increased have been developed. For example, in a long length kitchen towel, it takes a certain amount of time to use up one kitchen towel. In addition, since foodstuff is handled in a kitchen in a lot of occasions, there is a need for a packaging bag that can hygienically store the kitchen towel. In addition, when the packaging bag for the kitchen towel is torn, the packaging bag may not be neatly torn in many cases, and there is also a demand for a packaging film that is easy to open.

For example, JP-A-2003-104449 (Patent Document 1) discloses a package for packaging roll-shaped kitchen paper. In this package, a perforation for opening is provided in a vertical direction on a front surface of the package.

Patent Document 1: JP-A-2003-104449

SUMMARY

However, in the conventional packaging bag, a user may forcibly open the packaging bag from a place where the perforation is not provided without knowing a place where the perforation is provided or how to open the packaging bag. For this reason, a strong force is required to open the packaging bag, which is difficult for some users. In addition, since an opening location and a state after opening differ depending on the user, it may be difficult to take out a product from the packaging bag after opening. Furthermore, even in the case of opening along a perforation for opening, a handle portion or a body of the packaging bag tends to be torn over a wide range, and the remaining product may not be stored cleanly in the packaging bag after opening in some cases.

An object of the invention is to provide a packaging bag excellent in openability, a take-out property, and storability after opening.

An aspect of the invention is a packaging bag including a body for storing a plurality of articles to be packaged, in which the body has a top surface part, a bottom surface part facing the top surface part in a vertical direction, and a plurality of lateral surface parts disposed between the top surface part and the bottom surface part, a slash part for opening is provided on at least one of the plurality of lateral surface parts, and the slash part includes a first slit extending in the vertical direction from near the top surface part to near the bottom surface part, and a second slit extending in a traverse direction intersecting the vertical direction continuously with one end of the first slit on a side of the top surface part.

According to an aspect of the invention, it is possible to provide a packaging bag excellent in openability, a take-out property, and storability after opening.

BRIEF DESCRIPTION OF THE DRAWINGS

FIG. 1 is a diagram illustrating a packaging bag according to an embodiment (first embodiment) of the invention.

FIG. 2 is a diagram illustrating a state (before opening) in which articles to be packaged are stored in the packaging bag according to the first embodiment.

FIG. 3 is a diagram illustrating a usage state (after opening) of the packaging bag according to the first embodiment.

FIG. 4 is a diagram illustrating a usage state (after taking out one of the articles to be packaged) of the packaging bag according to the first embodiment.

FIG. 5 is a diagram viewed from above in a vertical direction while omitting a handle portion in FIG. 4.

FIG. 6 is a diagram illustrating a state in which remaining articles to be packaged are stored in FIG. 5.

FIG. 7 is a diagram illustrating a state in which remaining articles to be packaged are stored after taking out one article to be packaged in FIG. 6.

FIG. 8 is a diagram illustrating a state in which a remaining article to be packaged is stored after taking out one article to be packaged in FIG. 7.

FIG. 9 is a diagram illustrating a packaging bag according to an embodiment (second embodiment) of the invention.

FIG. 10 is a diagram illustrating a packaging bag according to an embodiment (third embodiment) of the invention.

FIG. 11 is a diagram illustrating a packaging bag according to an embodiment (fourth embodiment) of the invention.

FIG. 12 is a diagram illustrating a packaging bag according to an embodiment (fifth embodiment) of the invention.

FIG. 13 is a diagram illustrating a packaging bag according to an embodiment (sixth embodiment) of the invention.

FIG. 14 is a diagram illustrating a packaging bag according to a modification of the sixth embodiment.

FIG. 15 is a diagram illustrating a usage state (after opening a part of a lateral surface part on a top surface part side) of the packaging bag according to the modification of the sixth embodiment.

FIG. 16 is a diagram illustrating a usage state (after taking out one of articles to be packaged) of the packaging bag according to the modification of the sixth embodiment.

FIG. 17 is a diagram illustrating a usage state (after taking out three articles to be packaged after opening a part of the lateral surface part on a bottom surface part side) of the packaging bag according to the modification of the sixth embodiment.

FIG. 18 is a diagram illustrating a packaging bag according to an embodiment (seventh embodiment) of the invention.

FIG. 19 is a diagram illustrating a conventional packaging bag (Comparative Example 1).

FIG. 20 is a diagram illustrating a conventional packaging bag (Comparative Example 2).

FIG. 21 is a diagram illustrating a conventional packaging bag (Comparative Example 3).

DETAILED DESCRIPTION

Hereinafter, embodiments of the invention will be described in detail with reference to the drawings. Note that in this specification, to facilitate understanding, the scale of each member in each drawing may differ from the actual scale. Further, in the following description, common parts in each drawing are denoted by the same reference numerals, and description thereof may be omitted.

In addition, in this specification, one side in a vertical direction (height direction) of a packaging bag may be referred to as "up" or an upper side, and the other side may be referred to as "down" or a lower side. In addition, a three-dimensional orthogonal coordinate system in 3-axis directions (X direction, Y direction, and Z direction) is used. A width direction (left-right direction or lateral direction orthogonal to the vertical direction) of the packaging bag is defined as the X direction, a depth direction (direction perpendicular to the left-right direction) of the packaging bag is defined as the Y direction, and the height direction (vertical direction) of the packaging bag is defined as the Z direction.

FIG. 1 is a diagram illustrating a packaging bag according to a first embodiment of embodiments of the invention. In addition, FIG. 2 is a diagram illustrating a state (before opening) in which a handle portion is raised while articles to be packaged are stored (accommodated) in FIG. 1. In FIG. 1, a packaging bag 100 includes a body 10, a handle portion 20, and a finger hook 30. The packaging bag 100 is manufactured using a bag-making machine from a resin film, etc. The packaging bag 100 is an example of a packaging bag of the invention. In addition, the body 10 is an example of a body included in the packaging bag of the invention.

As illustrated in FIG. 2, the body 10 is included in a body of the packaging bag 100 in which a plurality of articles to be packaged P is stored. The body 10 is made of a tubular film obtained by forming a resin film into a tubular shape, and has a structure in which the tubular film is folded in a gusset shape to form a bag shape (see FIG. 2).

A material of the tubular film (resin film) forming the body 10 is arbitrary. As such a resin film, for example, it is possible to use a resin film such as polyethylene (PE) or a stacked body (PE/EVOH/PE) of PE-ethylene vinyl alcohol copolymer (EVOH)-PE. In addition, a thickness of the resin film is arbitrary. For example, when PE or PE/EVOH/PE is used as the resin film, the thickness of the resin film can be set to 10 to 70 μm, preferably 15 to 60 μm, and more preferably 20 to 50 μm.

A plurality of (four) pieces of roll-shaped kitchen paper is stored in the body 10 as an example of the articles to be packaged P (see FIG. 2). The size of the article to be packaged P (kitchen paper) is not particularly limited. However, in the state of being stored in the packaging bag 100, a height (roll width) in the vertical direction (Z direction) is preferably about 170 mm to 300 mm, and a width (roll diameter) in the traverse direction (X direction) is preferably about 90 mm to 120 mm.

In addition, each of the articles to be packaged P (kitchen paper) is obtained by winding a belt-shaped sheet around a paper tube HC (see FIG. 5). Note that a form of the article to be packaged P is not limited to a roll shape, and the article to be packaged P may be stored in another form such as a stacked shape. Further, the articles to be packaged P stored in the body 10 are not limited to kitchen paper, and it is possible to store other articles such as toilet paper, tissue paper, baby or nursing disposable diapers, and sanitary napkins.

In addition, the number of articles stored in the body 10 is not particularly limited as long as a plurality of articles is stored, and may be two or three or more. In an example illustrated in FIG. 2, four pieces of roll-shaped kitchen paper (articles to be packaged P1 to P4) arranged in one stage are stored in the body 10. Note that arrangement of the articles to be packaged stored in the body 10 is not limited to this arrangement. For example, five or more pieces of kitchen paper (articles to be packaged P) in one stage may be stored in the body 10.

The body 10 has a top surface part 11, a bottom surface part 12, a pair of first lateral surface parts 13, and a pair of second lateral surface parts 14. The top surface part 11 is formed on the upper side of the body 10. The bottom surface part 12 is formed on the lower side of the body 10 and faces the top surface part 11 in the Z direction (vertical direction or height direction of the packaging bag 100).

The pair of first lateral surface parts 13 is disposed between the top surface part 11 and the bottom surface part 12, and has one lateral surface part 13*a* and the other lateral surface part 13*b* facing each other in the Y direction (the depth direction of the packaging bag 100) (see FIGS. 1 and 2). In addition, the pair of second lateral surface parts 14 is disposed between the top surface part 11 and the bottom surface part 12, and has one lateral surface part 14*a* and the other lateral surface part 14*b* facing each other in the X direction (the width direction of the packaging bag 100 or the left-right direction orthogonal to the vertical direction) (see FIGS. 1 and 2).

Note that the top surface part 11 is an example of a top surface part included in the body of the packaging bag according to the invention. In addition, the bottom surface part 12 is an example of a bottom surface part included in the body of the packaging bag according to the invention. Further, the pair of first lateral surface parts 13 and the pair of lateral surface parts 14 are an example of a plurality of lateral surface parts included in the body of the packaging bag according to the invention.

As illustrated in FIGS. 1 and 2, the handle portion 20 is provided on the top surface part 11 of the body 10. The handle portion 20 is included in a portion of the packaging bag 100 grabbed (or held) by a hand or a finger (hereinafter referred to as a finger). The handle portion 20 can be formed of a resin film, etc. similarly to the body 10. The handle portion 20 is integrally formed with the body 10 on a connection portion 11*a* of the top surface part 11 by a seal part (not illustrated) formed by heat sealing (heat seal).

Note that heat sealing (heat seal) for forming the seal part can be performed by, for example, a scheme (stamp scheme) in which the resin film folded in the gusset shape is embossed with a hot plate for forming a handle. In addition, an air hole (not illustrated) connecting the body 10 and the outside of the packaging bag 100 may be provided in the handle portion 20 so that the body 10 to which the handle portion 20 is attached does not tear during manufacturing or distribution of the packaging bag 100.

The handle portion 20 is further provided with the finger hook 30 for hooking the finger when holding the handle portion 20. The finger hook 30 is formed in a center part of the handle portion 20 in the left-right direction (X direction). In addition, the finger hook 30 is formed by two elliptical slits disposed at a predetermined interval in the left-right direction (X direction). The slits may have any form. For example, perforations may be formed, and the finger hooks may be formed by breaking the perforations.

Note that a shape of the finger hook 30 is not limited to an elliptical shape, and may be a linear shape, a curved shape, a circular shape, an oval shape, a rectangular shape, etc. or shapes similar to these shapes. Further, even though the finger hook 30 is formed by two slits, the number of slits is not limited. Therefore, the finger hook 30 may be formed by one slit or three or more slits.

Further, the finger hook 30 can be disposed in the handle portion 20 while being surrounded by a heat seal (not illustrated). The heat seal can be formed by heat sealing as in the case of forming the handle portion 20. The finger hook 30 can be disposed inside the heat seal and apart from the heat seal.

In addition, the handle portion 20 may be provided with a reinforcing film (not illustrated) that reinforces a portion of the handle portion 20 where the finger hook 30 is provided.

A mode of such a reinforcing film is arbitrary. However, it is preferable that the reinforcing film is attached to the handle portion 20 by heat sealing (heat seal) as in the case of forming the handle portion 20. In addition, the reinforcing film can be formed of a belt-shaped resin film. A material of the reinforcing film may be the same as or different from the material of the resin film forming the handle portion 20. A thickness dimension of the reinforcing film is arbitrary. For example, from a viewpoint of preventing the handle portion 20 from extending or breaking, the thickness is preferably set to 20 μm or more.

As illustrated in FIGS. 1 and 2, the packaging bag 100 according to the first embodiment is provided with a slash part S (hereinafter referred to as a slash part S for opening) for opening the packaging bag 100 on one lateral surface part 13 (hereinafter referred to as the lateral surface part 13*a*) of the pair of first lateral surface parts 13 on a side where the packaging bag 100 is viewed from the front surface. Note that the lateral surface part 13*a* in which the slash part S for opening is provided is an example of at least one of the plurality of lateral surface parts included in the body of the packaging bag according to the invention.

Note that a form of the slash part S formed in the lateral surface part 13*a* is arbitrary. For example, the slash part S may be formed by a notch such as a perforation. In the first embodiment, the slash part S is formed by a perforation, and a notch is formed by breaking the perforation. Note that in the first embodiment, as illustrated in FIGS. 1 and 2, the perforation forming the slash part S is indicated by a broken line.

The slash part S further has a first slit 40, a second slit 50, and a third slit 60. As illustrated in FIGS. 1 and 2, the first slit 40 extends in the vertical direction (Z direction) from near the top surface part 11 to near the bottom surface part 12 of the body 10 in the packaging bag 100. That is, the first slit 40 is formed to extend over substantially the entire region of the lateral surface part 13*a* of the body 10 of the packaging bag 100 in the vertical direction.

In addition, as illustrated in FIG. 2, the first slit 40 is formed in the lateral surface part 13*a* along a boundary BP between at least two adjacent articles to be packaged P (articles to be packaged P1 and P2) among a plurality of articles to be packaged P (articles to be packaged P1 to P4). According to such a configuration, the first slit 40 is provided along the boundary BP between the articles to be packaged P1 and P2 with respect to the lateral surface part 13*a* in contact with two articles to be packaged P1 and P2 adjacent to each other in the state of being stored in the packaging bag 100 (see FIG. 2).

In addition, in the first embodiment, a length L1 of the first slit 40 is a length from the vicinity of the top surface part 11 to the vicinity of the bottom surface part 12 in the vertical direction (Z direction). Note that an upper limit of a ratio of the length L1 of the first slit 40 (hereinafter referred to as a ratio L1) in the case of setting a width W2 of the article to be packaged P (article to be packaged P1) in the vertical direction (Z direction) is 100% can be set to 100% or less. In addition, a lower limit of the ratio L1 is preferably 90 or more, more preferably 85% or more, further preferably 80% or more (see FIG. 2).

In addition, the length L1 of the first slit 40 can be specified from a distance D1 between the second slit 50 and the top surface part 11 in the vertical direction (Z direction) and a distance D2 between the third slit 60 and the bottom surface part 12 in the vertical direction (Z direction).

Note that a lower limit of a ratio of the distance D1 between the second slit 50 and the top surface part 11 (hereinafter referred to as a ratio D1) in the case of setting the width W2 of the article to be packaged P (article to be packaged P1) in the vertical direction (Z direction) to 100% can be set to 0% or more. In addition, an upper limit of the ratio D1 is preferably less than 20%, more preferably less than 15%, and further preferably less than 10% (see FIG. 2).

In addition, a lower limit of a ratio of the distance D2 between the third slit 60 and the bottom surface part 12 (hereinafter referred to as a ratio D2) in the case of setting the width W2 of the article to be packaged P (article to be packaged P1) in the vertical direction (Z direction) to 100% can be set to 0% or more. In addition, an upper limit of the ratio D2 is preferably less than 20%, more preferably less than 15%, and further preferably less than 10% (see FIG. 2).

In addition, as illustrated in FIGS. 1 and 2, in the packaging bag 100, the second slit 50 is continuous with one end 40*a* of the first slit 40 on the top surface part 11 side, and extends in the traverse direction (X direction) intersecting the vertical direction (Z direction). Specifically, the second slit 50 is formed to be continuous with the first slit 40 and extend in the traverse direction (X direction) orthogonal to the vertical direction (Z direction) from the one end 40*a* of the first slit 40 on the top surface part 11 side.

In addition, the length L2 of the second slit 50 is the same as or shorter than the width W1 of one article to be packaged P (article to be packaged P1) in the traverse direction (X direction). In the first embodiment, the length L2 of the second slit 50 is shorter than the width W1 of the article to be packaged P1 stored in the packaging bag 100 in the traverse direction (X direction) (see FIG. 2). In the first embodiment, when the length L2 of the second slit 50 is set to be the same as or shorter than the width W1 of the article to be packaged P1 in the state of being stored in the packaging bag 100 in the traverse direction (X direction), a width of an opening hole OP formed after opening the packaging bag 100 in the traverse direction (X direction) on the top surface part 11 side becomes less than or equal to the width W1 of the article to be packaged P1 in the state of being stored in the packaging bag 100 in the traverse direction (X direction).

Note that an upper limit of a ratio of the length L2 of the second slit 50 (hereinafter referred to as a ratio L2) in the case of setting the width W1 of the article to be packaged P (article to be packaged P1) in the traverse direction (X direction) to 100% can be set to 100% or less, and is preferably 80% or less, and more preferably 60% or less. In addition, a lower limit of the ratio L2 can be set to be greater than 0%, and is preferably greater than 20%, and more preferably greater than 40%.

Furthermore, as illustrated in FIGS. 1 and 2, in the packaging bag 100, the third slit 60 is continuous with the other end 40*b* of the first slit 40 on the bottom surface part 12 side and faces the second slit 50 in the vertical direction (Z direction) to extend in the traverse direction (X direction). Specifically, the third slit 60 is formed to be continuous with the first slit 40 and extend in the traverse direction (X direction) orthogonal to the vertical direction (Z direction) from the other end 40*b* of the first slit 40 on the bottom surface part 12 side.

In addition, a length L3 of the third slit 60 is also the same as or shorter than the width W1 of one article to be packaged P (article to be packaged P1) in the traverse direction (X direction). In the first embodiment, the length L3 of the third slit 60 is shorter than the width W1 of the article to be packaged P1 stored in the packaging bag 100 in the traverse direction (X direction) (see FIG. 2). In the first embodiment, when the length L3 of the third slit 60 is set to be the same as or shorter than the width W1 of the article to be packaged P1 stored in the packaging bag 100 in the traverse direction (X direction), the width of the opening hole OP having a rectangular shape described below in the traverse direction (X direction) becomes less than or equal to the width W1 of the article to be packaged P1 stored in the packaging bag 100 in the traverse direction (X direction) (see FIGS. 3 to 5).

Note that an upper limit of a ratio of the length L3 of the third slit 60 (hereinafter referred to as a ratio L3) in the case of setting the width W1 of the article to be packaged P (article to be packaged P1) in the traverse direction (X direction) to 100% can be set to 100% or less, and is preferably 80% or less, and more preferably 60% or less. In addition, a lower limit of the ratio L3 can be set to 0% or more.

Further, in the first embodiment, an adhesive portion 70 is provided on the lateral surface part 13*a* on the opposite side from the second slit 50 with respect to the first slit 40. Here, when the lateral surface part 13*a* is divided into a region where the second slit 50 is provided and a region where the second slit 50 is not provided based on the first slit 40, the opposite side from the second slit 50 with respect to the first slit 40 refers to the region where the second slit 50 is not provided.

A position at which the adhesive portion 70 is provided is not particularly limited as long as the position is on the opposite side from the second slit 50 with respect to the first slit 40 on the lateral surface part 13*a*. However, the position is preferably at a center part of the lateral surface part 13*a* in the vertical direction (Z direction). In addition, the position at which the adhesive portion 70 is provided is not limited to the lateral surface part 13*a*. The position may be set to a position at which a broken piece FG described below is attached to an outer periphery of the body 10 of the packaging bag 100 when the lateral surface part 13*a* (the outer periphery of the body 10 of the packaging bag 100) is covered with the broken piece FG.

In addition, the number of adhesive portions 70 is not limited to one, and a plurality of adhesive portions 70 may be provided depending on the range of covering the body 10 of the packaging bag 100. Further, a mode of the adhesive portion 70 is not particularly limited. For example, a commercially available pressure-sensitive adhesive may be applied to the lateral surface part 13*a*, or a sticker to which the pressure-sensitive adhesive is applied in advance may be attached to the lateral surface part 13*a*. Note that the adhesive portion 70 is an example of an adhesive portion provided on the body of the packaging bag according to the invention.

Here, the case of opening the packaging bag 100 of the first embodiment will be described with reference to FIGS. 2 to 8. In the first embodiment, as described above, the slash part S including the first slit 40, the second slit 50, and the third slit 60 is provided on the lateral surface part 13*a* of the body 10 of the packaging bag 100 (see FIG. 2). In this way, in the packaging bag 100 of the first embodiment, since the U-shaped slash part S is disposed at a conspicuous position of the lateral surface part 13*a* of the body of the packaging bag 100, it is easy to find a place where the packaging bag 100 is opened.

In addition, in the first embodiment, since the length L1 of the first slit 40 is a length from near the top surface part 11 to near the bottom surface part 12 in the vertical direction (Z direction), the first slit 40 can be broken in the vertical direction (Z direction) with a small force when opening the packaging bag 100. In addition, when the first slit 40 is broken, the second slit 50 on the top surface part 11 side and the third slit 60 on the bottom surface part 12 side are further broken continuously with the first slit 40 in the traverse direction (X direction). In this way, in the first embodiment, the rectangular opening hole OP and the broken piece FG can be formed on the lateral surface part 13*a* of the body 10 (see FIG. 3). Therefore, the packaging bag 100 of the first embodiment has excellent openability.

In addition, in the first embodiment, as described above, the length L1 of the first slit 40 in the vertical direction (Z direction) is the length from near the top surface part 11 to near the bottom surface part 12. For this reason, the length of the first slit 40 in the vertical direction (Z direction) is approximately the same as the height of the article to be packaged P in the state of being stored in the packaging bag 100 (see FIG. 3). In addition, as described above, the length of the rectangular opening hole OP formed on the lateral surface part 13*a* of the body 10 in the vertical direction (Z direction) becomes approximately the same as the height of the article to be packaged P in the state of being stored in the packaging bag 100 (see FIG. 3). For this reason, in the packaging bag 100 of the first embodiment, it is easy to take out the stored articles to be packaged P, and the product take-out property is excellent (see FIGS. 3 and 4).

In addition, in the first embodiment, since the length L1 of the first slit 40 is the length from near the top surface part 11 to near the bottom surface part 12 in the vertical direction (Z direction) as described above, the length L1 of the first slit 40 becomes shorter than the length of the article to be packaged P stored in the packaging bag 100 in the vertical direction (Z direction) (see FIG. 3). In this way, in the first embodiment, both end portions of the article to be packaged P in the vertical direction (Z direction) can be pressed by parts 13*c* and 13*d* of the lateral surface part adjacent to an upper end and a lower end of the opening hole OP formed after opening the packaging bag 100 (see FIG. 3). Therefore, in the packaging bag 100 of the first embodiment, it is possible to prevent the article to be packaged P (article to be packaged P1) from coming off from the opening hole OP after the packaging bag 100 is opened.

In addition, in the first embodiment, as illustrated in FIG. 3, at the same time as the rectangular opening hole OP is formed on the lateral surface part 13*a* of the body 10, the broken piece FG (part of the lateral surface part 13*a* of the body 10 formed (or turned up) by breaking the slash part S) is formed. The broken piece FG is formed by a part of the lateral surface part 13*a* of the body 10 formed by breaking the slash part S. Then, the shape of the broken piece FG becomes a rectangular shape corresponding to the shape of the opening hole OP (see FIG. 3).

In the first embodiment, as illustrated in FIGS. 3 to 5, after taking out some (article to be packaged P1) of the articles to be packaged P, it is possible to cover the lateral surface part 13*a* (the outer periphery of the body 10 of the packaging bag 100) with the rectangular broken piece FG as illustrated in FIG. 6. In this way, the opening hole OP can be closed (or blocked), and the remaining articles to be packaged P2 to P4 can be protected from dirt and dust (dirt, dust, mote, etc.) after opening the packaging bag 100 (see FIG. 6).

In addition, in the first embodiment, the adhesive portion 70 is provided on the lateral surface part 13*a* (see FIGS. 2 to 5). For this reason, as described above, when the outer periphery of the body 10 of the packaging bag 100 is covered with the broken piece FG of the packaging bag 100 after taking out some (article to be packaged P1) of the articles to be packaged P from the packaging bag 100, it is possible to attach the broken piece FG of the packaging bag 100 to the adhesive portion 70 (see FIG. 6). In this way, after opening the packaging bag 100, the packaging bag 100 can be hermetically sealed, and the remaining articles to be packaged P (articles to be packaged P2 to P4) stored in the packaging bag 100 can be bundled (see FIG. 6).

Further, as illustrated in FIGS. 6 and 7, after taking out some (article to be packaged P2) of the articles to be packaged P, the outer periphery of the body 10 of the packaging bag 100 can be covered with the rectangular broken piece FG as illustrated in FIG. 7. In this way, the opening hole OP can be closed (or blocked), and the remaining articles to be packaged P3 and P4 can be protected from dirt and dust after opening the packaging bag 100 (see FIG. 7). In addition, by attaching the broken piece FG of the packaging bag 100 to the adhesive portion 70, it is possible to bundle the remaining articles to be packaged P (articles to be packaged P3 and P4) stored in the packaging bag 100 while hermetically sealing the packaging bag 100 after opening (see FIG. 7).

Similarly, as illustrated in FIGS. 7 and 8, after taking out some (article to be packaged P3) of the articles to be packaged P, the outer periphery of the body 10 of the packaging bag 100 can be covered with the rectangular broken piece FG as illustrated in FIG. 8. In this way, the opening hole OP can be closed (or blocked), and the remaining article to be packaged P4 can be protected from dirt and dust after opening the packaging bag 100. In addition, by attaching the broken piece FG of the packaging bag 100 to the adhesive portion 70, it is possible to hermetically seal the packaging bag 100 after opening in which the last remaining one (article to be packaged P4) of the articles to be packaged P is stored (see FIG. 8). In this way, the packaging bag 100 of the first embodiment is excellent in storability after opening (see FIGS. 6 to 8).

In addition, in the first embodiment, the first slit 40 is formed along the boundary BP between the articles to be packaged P1 and P2 with respect to the lateral surface part 13*a* in contact with the two adjacent articles to be packaged P1 and P2 in the state of being stored in the packaging bag 100. In this way, when the packaging bag 100 is opened, the finger H is easily caught on the first slit 40, and thus the first slit 40 is easily broken (see FIGS. 2, 4, and 5). Further, the end portion of the broken piece FG formed when the first slit 40 is broken is easily grabbed, and the second slit is easily broken (see FIG. 3). Therefore, the packaging bag 100 of the first embodiment is more excellent in the openability.

Note that when the plurality of articles to be packaged P is roll-shaped kitchen paper as in the first embodiment, a space SP is formed between the articles to be packaged P1 and P2 and the lateral surface part 13*a* along the boundary BP between the two adjacent articles to be packaged P1 and P2 (see FIGS. 2 and 5). In this case, by forming the first slit 40 along the boundary BP between the articles to be packaged P1 and P2, it is possible to dispose the first slit 40 with respect to the space SP between the articles to be packaged P1 and P2 and the lateral surface part 13*a* (see FIGS. 2 and 5).

In this way, when a plurality of pieces of roll-shaped kitchen paper is stored in the packaging bag 100 as the articles to be packaged P, it is possible to easily break the first slit 40 by simply pressing the lateral surface part 13*a* facing the boundary BP between the articles to be packaged P1 and P2 with a finger. For this reason, in the first embodiment, when the packaging bag 100 is opened, the first slit 40 can be reliably broken in the vertical direction (Z direction) with a small force.

In addition, in the first embodiment, as described above, when the length L2 of the second slit 50 is set to be less than or equal to the width W1 of one article to be packaged P in the traverse direction (X direction), the width of the opening hole OP, which is formed after opening the packaging bag 100, in the traverse direction (X direction) on the top surface part 11 side becomes less than or equal to the width W1 of the article to be packaged P1 in the state of being stored in the packaging bag 100 in the traverse direction (X direction). In this way, in the first embodiment, while ensuring a region in the opening hole OP for taking out the articles to be packaged P, it is possible to press the articles to be packaged P by parts 13*e* and 13*f* of the lateral surface part 13*a* adjacent to the opening hole OP in the traverse direction (X direction). Therefore, according to the first embodiment, it is possible to further prevent the articles to be packaged P from coming off from the opening hole OP after the packaging bag 100 is opened.

Further, in the first embodiment, as described above, when the length L3 of the third slit 60 is shortened to the width W1 or less of the articles to be packaged P stored in the packaging bag 100 in the traverse direction (X direction), the width of the formed rectangular opening hole OP in the traverse direction (X direction) becomes less than or equal to the width W1 of the articles to be packaged P stored in the packaging bag 100 in the traverse direction (X direction). In this way, in the first embodiment, it is possible to ensure a sufficient region in the opening hole OP for taking out the articles to be packaged P. Moreover, the articles to be packaged P can be pressed by the parts 13*c* and 13*d* of the lateral surface part adjacent to both end portions of the rectangular opening hole OP formed after opening the packaging bag 100 in the vertical direction (Z direction) and the parts 13*e* and 13*f* of the lateral surface part adjacent to the both end portions in the traverse direction (X direction). Therefore, the packaging bag 100 of the first embodiment can reliably prevent the articles to be packaged P from coming off from the opening hole OP while improving the take-out property of the articles to be packaged P.

FIG. 9 is a diagram illustrating a packaging bag according to a second embodiment of the invention. In a packaging bag 100 of the second embodiment, in a configuration in which the second slit 50 continuous with the one end 40*a* of the first slit 40 on the top surface part 11 side extends in the traverse direction (X direction) intersecting the vertical direction (Z direction), one end of the second slit 50 connected to the one end 40*a* of the first slit 40 on the top surface part 11 side can be curved or inclined. In addition, in a configuration in which the third slit 60 continuous with the other end 40*b* of the first slit 40 on the bottom surface part 12 side extends in the traverse direction (X direction) intersecting the vertical direction (Z direction), one end of the third slit 60 connected to the other end 40*b* of the first slit 40 on the bottom surface part 12 side can be curved or inclined.

In the second embodiment, the second slit 50 has a base portion 51 and a sloped portion 52 in which one end of the second slit 50 is inclined with respect to the base portion 51. By adopting such a configuration, in the second embodiment, a force in the vertical direction (Z direction) that breaks the first slit 40 when opening the packaging bag 100 becomes easy to be transmitted in the traverse direction (X direction) in which the second slit 50 is broken. For this reason, even when the second slit 50 is formed on the top surface part 11 side with respect to the first slit 40, the packaging bag 100 can be opened with a smaller force. In addition, when the slash part S is broken from the first slit 40 to the second slit 50, it is possible to prevent the slash part S from breaking in an unexpected direction.

In the second embodiment, further, the third slit 60 has a base portion 61 and a sloped portion 62 in which one end of the third slit 60 is inclined with respect to the base portion 61. By adopting such a configuration, in the second embodiment, a force in the vertical direction (Z direction) that breaks the first slit 40 when opening the packaging bag 100 becomes easy to be transmitted in the traverse direction (X direction) in which the third slit 60 is broken. For this reason, even when the third slit 60 is formed on the bottom surface part 12 side with respect to the first slit 40, the packaging bag 100 can be opened with a smaller force. In addition, when the slash part S is broken from the first slit 40 to the third slit 60, it is possible to prevent the slash part S from breaking in an unexpected direction.

FIG. 10 is a diagram illustrating a packaging bag according to a third embodiment of the invention. In a packaging bag 100 of the third embodiment, as illustrated in FIG. 10, the length L3 of the third slit 60 is shorter than the length L2 of the second slit 50. In the third embodiment, by setting the length L3 of the third slit 60 provided on the bottom surface part 12 side to be shorter than the length L2 of the second slit 50 provided on the top surface part 11 side, the width of the opening hole OP in the traverse direction (X direction) gradually decreases from the top surface part 11 side to the bottom surface part 12 side. In this way, the opening hole OP formed after opening the packaging bag 100 has a trapezoidal shape in which the bottom surface part 12 side is an upper bottom and the top surface part side is a lower bottom.

In the third embodiment, by forming such a trapezoidal opening hole OP, it is possible to press both end portions of the articles to be packaged P in the traverse direction (X direction) by parts 13*e* and 13*f* of the lateral surface part 13*a* adjacent to both end portions of the trapezoidal opening hole OP formed after opening the packaging bag 100 in the traverse direction (X direction) while ensuring a sufficient region in the opening hole OP for taking out the articles to be packaged P. Therefore, the packaging bag 100 of the third embodiment can reliably prevent the articles to be packaged P from coming off from the opening hole OP while maintaining the take-out property of the articles to be packaged P.

FIG. 11 is a diagram illustrating a packaging bag according to a fourth embodiment of the invention. In a packaging bag 100 of the fourth embodiment, as illustrated in FIG. 11, the distance D2 between the third slit 60 and the bottom surface part 12 in the vertical direction (Z direction) is longer than the distance D1 between the second slit 50 and the top surface part 11 in the vertical direction (Z direction). In this way, in the fourth embodiment, by setting the distance D2 between the third slit 60 and the bottom surface part 12 in the vertical direction (Z direction) to be longer than the distance D1 between the second slit 50 and the top surface part 11, a wall portion WP for pressing the articles to be packaged P can be formed in the part 13*d* of the lateral surface part 13*a* adjacent to the end portion of the opening hole OP on the bottom surface part 12 side. In this way, it is possible to further prevent the articles to be packaged P from falling off from the opening hole OP formed after the packaging bag 100 is opened.

Note that when the distance D2 between the third slit 60 and the bottom surface part 12 in the vertical direction (Z direction) is set to be longer than the distance D1 between the second slit 50 and the top surface part 11, the lower limit of the ratio D2 is preferably set to 20% or more, more preferably 15% or more, and further preferably 10% or more. In addition, the upper limit of the ratio D2 is preferably set to be smaller than 50%, more preferably smaller than 40%, and further preferably smaller than 30%.

FIG. 12 is a diagram illustrating a packaging bag according to a fifth embodiment of the invention. In a packaging bag 100 of the fifth embodiment, as illustrated in FIG. 12, a curved portion 41 is formed at a center part 40*c* of the first slit 40. The curved portion 41 has a shape protruding to the opposite side from the second slit 50 with respect to the first slit 40 (region of the lateral surface part 13*a* in which the second slit 50 is not provided) (curved in a convex shape). The packaging bag 100 of the fifth embodiment has a configuration in which the curved portion 41 is further provided in the packaging bag 100 of the second embodiment. Note that the curved portion 41 is an example of a curved portion of the first slit provided on the body of the packaging bag according to the invention.

In the fifth embodiment, by providing such a curved portion 41 at the center part 40*c* of the first slit 40, the finger H is easily caught in the center part 40*c* of the first slit 40, and the first slit 40 can be easily broken. In addition, after the first slit 40 is broken, a broken piece is formed at the center part 40*c* of the first slit 40 to correspond to the curved portion 41. By grabbing the broken piece corresponding to the curved portion 41, the second slit 50 and/or the third slit 60 can be easily broken. Therefore, excellent openability of the packaging bag 100 of the fifth embodiment is further improved.

FIG. 13 is a diagram illustrating a packaging bag according to a sixth embodiment of the invention. In a packaging bag 100 of the sixth embodiment, as illustrated in FIG. 13, the slash part S formed on the lateral surface part 13*a* further has a fourth slit 80. In addition, the fourth slit 80 is continuous with the center part 40*c* of the first slit 40, faces the second slit 50 in the vertical direction (Z direction), and extends in the traverse direction (X direction). That is, in the slash part S for opening provided on the lateral surface part 13*a* of the body 10 of the packaging bag 100, further, the fourth slit 80 continuous with the center part 40*c* of the first slit 40 is formed to face the second slit 50 in the vertical direction (Z direction) and extend in the traverse direction (X direction).

In addition, a length L4 of the fourth slit 80 is also the same as or shorter than the width W1 of one article to be packaged P (article to be packaged P1) in the traverse direction (X direction). In the sixth embodiment, the length L4 of the fourth slit 80 is shorter than the width W1 of the article to be packaged P1 stored in the packaging bag 100 in the traverse direction (X direction) (see FIG. 13). In the sixth embodiment, by setting the length L4 of the fourth slit 80 to be the same as or shorter than the width W1 of the article to be packaged P1 stored in the packaging bag 100 in the traverse direction (X direction), the width of the formed rectangular opening hole in the traverse direction (X direction) becomes less than or equal to the width W1 of the article to be packaged P stored in the packaging bag 100 in the traverse direction (X direction) (see FIGS. 13 and 14).

Note that an upper limit a ratio of the length L4 of the fourth slit 80 (hereinafter referred to as a ratio L4) in the case of setting the width W1 of the article to be packaged P (article to be packaged P1) in the traverse direction (X direction) to 100% can be set to 100% or less, and is preferably 90% or less, and more preferably 70% or less. In addition, a lower limit of the ratio L4 can be set to 0% or more.

In addition, a position of the first slit 40 to which the fourth slit 80 is connected is not limited to the center part 40*c*, and can be appropriately changed depending on the size of the width W2 of the articles to be packaged P in the vertical direction (Z direction), the number of accommodated articles to be packaged P, etc. Therefore, for example, a distance between the second slit 50 and the fourth slit 80 may be different from a distance between the third slit 60 and the fourth slit 80.

Here, a description will be given of the case in which the packaging bag 100 of the sixth embodiment is applied to a packaging bag that stores toilet paper as the articles to be packaged P (packaging bag according to a modification of the sixth embodiment of the invention) with reference to FIGS. 14 to 17. FIG. 14 is a diagram illustrating the packaging bag according to the modification of the sixth embodiment of the invention, and FIGS. 15 to 17 are diagrams illustrating the packaging bag according to the modification of the sixth embodiment.

In the packaging bag 100 according to the modification of the sixth embodiment, as the articles to be packaged P, a total of twelve pieces of roll-shaped toilet paper are accommodated in a state of being stacked in three stages, each of which has four pieces arranged thereon (see FIGS. 14 to 17). In addition, the dimensions of the articles to be packaged P (toilet paper) are not particularly limited. However, in the state of being stored in the packaging bag 100, the height (roll width) in the vertical direction (Z direction) is preferably about 85 mm to 150 mm, and the width (roll diameter) in the traverse direction (X direction) is preferably about 90 mm to 120 mm.

In the modification of the sixth embodiment, as illustrated in FIGS. 14 and 15, first, by breaking a part of the first slit 40 on the top surface part 11 side, the second slit 50, and the fourth slit 80, it is possible to form an opening hole OP1 having a length approximately half the height of the body 10 on the top surface part 11 side (see FIG. 15). In this way, even when a plurality of articles to be packaged P (articles to be packaged P1 to P4) is stored in a plurality of stages (three stages), it is possible to prevent the remaining articles to be packaged (P12 to P14, etc.) from coming off from the opening hole after the article to be packaged P11 on the upmost stage is taken out.

In the modification of the sixth embodiment, further, by breaking a remaining part of the first slit 40 on the bottom surface part 12 side and the third slit 60, it is possible to further form an opening hole OP2 having a length approximately half the height of the body 10 on the bottom surface part 12 side. In this way, in the case of taking out the article to be packaged P1 (articles to be packaged P12 and P13) on a lower stage of the article to be packaged P1 (article to be packaged P11) on an uppermost stage, it is possible to reliably take out the article to be packaged P1 (articles to be packaged P12 and P13) on the lower stage by breaking the remaining part of the first slit 40 on the bottom surface part 12 side and the third slit 60.

In addition, by breaking the part of the first slit 40 on the top surface part 11 side, the second slit 50, and the fourth slit 80, a broken piece FG1 is formed at the same time as the opening hole OP1 is formed on the lateral surface part 13*a* (see FIGS. 15 and 16). In the modification of the sixth embodiment, as described above, the opening hole OP1 can be closed (or blocked) by covering the lateral surface part 13*a* (outer periphery of the body 10 of the packaging bag 100) with the broken piece FG1. In this way, even after opening the packaging bag 100, the remaining articles to be packaged P1 (P12 to P13), P2 (P21 to P23), P3 (P31 to P33), and P4 (P41 to P43) can be protected from dirt and dust.

In addition, by further breaking the part of the first slit 40 on the bottom surface part 12 side and the third slit 60, a broken piece FG2 is formed at the same time as the opening hole OP2 is formed on the lateral surface part 13*a* (see FIG. 17). In the modification of the sixth embodiment, as described above, the opening hole OP2 can be closed (or blocked) by covering the lateral surface part 13*a* (outer periphery of the body 10 of the packaging bag 100) with the broken piece FG2. In this way, even after opening the packaging bag 100, the remaining articles to be packaged P2 (P21 to P23), P3 (P31 to P33), and P4 (P41 to P43) can be protected from dirt and dust.

Note that even though the adhesive portion 70 is not provided in the modification of the sixth embodiment, the adhesive portion 70 may be provided in the packaging bag 100 according to the modification of the sixth embodiment. In the modification of the sixth embodiment, a position of the adhesive portion 70 is not particularly limited. However, as described above, the position is preferably set to a position at which the broken pieces FG1 and FG2 are attached to the outer periphery of the body 10 of the packaging bag 100 when the lateral surface part 13*a* (outer periphery of the body 10 of the packaging bag 100) is covered with the broken pieces FG1 and FG2. In addition, in the modification of the sixth embodiment, even though the number of the adhesive portions 70 is not particularly limited, it is preferable to provide two adhesive portions 70 corresponding to the broken pieces FG1 and FG2.

FIG. 18 is a diagram illustrating a packaging bag according to a seventh embodiment of the invention. In a packaging bag 100 of the seventh embodiment, as illustrated in FIG. 18, the slash part S for opening provided on the lateral surface part 13*a* of the body 10 of the packaging bag 100 only includes the first slit 40 and the second slit 50 described above. That is, in the seventh embodiment, the third slit 60 is not provided when compared to the first embodiment of FIG. 1, etc. According to such a configuration, in the seventh embodiment, since the L-shaped slash part S is disposed at a conspicuous position on the lateral surface part 13*a* of the body 10 of the packaging bag 100, it is easy to find a place to open the packaging bag 100 of the seventh embodiment.

In addition, in the seventh embodiment, when the packaging bag 100 is opened, after the first slit 40 is broken in the vertical direction (Z direction), the second slit 50 on the top surface part 11 side is further broken continuously with the first slit 40 in the traverse direction (X direction). In this way, a triangular opening hole OP can be formed on the lateral surface part 13*a* of the body 10 (see FIG. 18). Therefore, the packaging bag 100 of the seventh embodiment is excellent in the openability.

In addition, in the seventh embodiment, as described above, in the triangular opening hole OP formed on the lateral surface part 13*a* of the body 10, the width of the opening hole OP in the traverse direction (X direction) gradually increases from the bottom surface part 12 side toward the top surface part 11 side (see FIG. 18). For this reason, in the seventh embodiment, it is easy to take out the articles to be packaged P stored in the packaging bag 100 from the opening hole OP. Therefore, the packaging bag 100 of the seventh embodiment is excellent in the product take-out property.

In addition, in the seventh embodiment, as described above, by forming the triangular opening hole OP on the lateral surface part 13*a* of the body 10, the broken piece FG of the packaging bag 100 has a triangular shape corresponding to the shape of the opening hole OP (see FIG. 18). For this reason, by covering the lateral surface part 13*a* of the body 10 of the packaging bag 100 (the outer periphery of the body 10 of the packaging bag 100) with the triangular broken piece FG after taking out some (article to be packaged P1) of the articles to be packaged P, it is possible to close (or block) the opening hole OP. In this way, in the seventh embodiment, even after opening the packaging bag 100, the product can be protected from dirt and dust. Therefore, the packaging bag 100 of the seventh embodiment is excellent in storability after opening.

Further, in the seventh embodiment, as described above, in the triangular opening hole OP formed on the lateral surface part 13*a* of the body 10, the width of the opening hole OP in the traverse direction (X direction) gradually decreases from the top surface part 11 side to the bottom surface part 12 side (see FIG. 18). In this way, an area for pressing the articles to be packaged P (article to be packaged P1) of the parts 13*e* and 13*f* of the lateral surface part 13*a* adjacent to the opening hole OP formed after the packaging bag 100 is opened in the traverse direction (X direction) gradually increases from the top surface part 11 side to the bottom surface part 12 side. Therefore, the packaging bag 100 of the seventh embodiment can prevent the articles to be packaged P from coming off from the opening hole OP after the packaging bag 100 is opened.

EXAMPLES

Hereinafter, the invention will be specifically described with reference to examples. Evaluation of the examples and comparative examples was performed by the following tests.

[Packaging Bag (Test Body)]

For Examples 1 to 5 and Comparative Examples 1 to 3, as the articles to be packaged P, a packaging bag 100 storing four pieces of roll-shaped kitchen paper ("Elleair kitchen towel 50 cut" manufactured by Daio Paper Co., Ltd.) was prepared. Referring to the dimensions of the kitchen paper, in the state of being stored in the packaging bag 100, a height (roll width) in the vertical direction (Z direction) is about 228 mm, and a width (roll diameter) in the traverse direction (X direction) is about 110 mm. Further, in Example 6, as the articles to be packaged P, a packaging bag 100 storing twelve pieces of roll-shaped toilet paper ("Elleair toilet tissue 60 m single (147 g/roll)" manufactured by Daio Paper Co., Ltd.) was prepared. Referring to the dimensions of the toilet paper, in the state of being stored in the packaging bag 100, a height (roll width) in the vertical direction (Z direction) is about 114 mm, and a width (roll diameter) in the traverse direction (X direction) is about 106 mm. In addition, the packaging bag 100 was produced by folding a 25 μm-thick polyethylene (PE) film, which is formed in a tubular shape, into a gusset shape using a bag-making machine.

[Durability (Pendulum Test)]

Durability when the user held the handle portion 20 by freely hanging the finger H on the finger hook 30 of the packaging bag 100 and moved the packaging bag 100 back and forth 10 times like a pendulum within a range of 180° (a pendulum test was performed) was evaluated. The pendulum test was carried out 5 times for each of the examples and comparative examples, and evaluated according to the following criterion.

○: No damage could be confirmed even once in 5 times (excellent)

X: Damage was confirmed once or more in 5 times (poor)

[Openability]

The ease of opening (openability) when the packaging bag 100 was opened was evaluated. The openability was evaluated according to the following criterion from an average value of results of tests conducted by five users and scored for each of the examples and the comparative examples. The Openability was evaluated excellent when the average value was 3.0 points or more.

5 points: significantly easy to open
4 points: easy to open
3 points: no opinion
2 points: difficult to open
1 point: significantly difficult to open

[Take-Out Property]

The easiness of taking out (take-out property) when one roll of the articles to be packaged P in the packaging bag 100 was taken out after the packaging bag 100 was opened was evaluated. The take-out property was evaluated according to the following criterion from an average value of results of tests conducted by five users and scored for each of the examples and the comparative examples. The take-out property was evaluated excellent when the average value was 3.5 points or more.

5 points: significantly easy to take out
4 points: easy to take out
3 points: no opinion
2 points: difficult to take out
1 point: significantly difficult to take out

[Storability]

After taking out one roll of the articles to be packaged P in the opened packaging bag 100, the easiness of storage (storability) after opening was evaluated based on whether or not the remaining articles to be packaged P in the packaging bag 100 can be covered (or wrapped) with the broken piece FG (or FG1 and FG2) of the packaging bag 100. The test was performed 5 times for each of the examples and comparative examples, and evaluation was performed according to the following criterion.

○: Wrapping was allowed 5 times out of 5 times (excellent)

X: Wrapping was not allowed once or more in 5 times (poor)

Example 1

The packaging bag 100 of the first embodiment illustrated in FIGS. 1 and 2 was prepared. In this packaging bag 100, the first slit 40 extending in the vertical direction (Z direction) from near the top surface part 11 to near the bottom surface part 12 was formed on the lateral surface part 13*a* of the body 10. In addition, the second slit 50 extending in the traverse direction (X direction) was formed on the top surface part 11 side of the lateral surface part 13*a* continuously with the one end 40*a* of the first slit 40. In addition, the third slit 60 extending in the traverse direction (X direction) was formed continuously with the other end 40*b* of the first slit 40 on the bottom surface part 12 side of the lateral surface part 13*a* to face the second slit 50 in the vertical direction (Z direction). In addition, the length L1 of the first slit 40 was set to about 228 mm (ratio L1: about 100%), the length L2 of the second slit 50 was set to about 66 mm (ratio L2: 60%), the length L3 of the third slit 60 was set to about 66 mm (ratio L3: about 60%), the distance D1 between the second slit 50 and the top surface part 11 was set to about 0 mm (ratio D1: about 0%), and the distance D2 between the third slit 60 and the bottom surface part 12 was set to about 0 mm (ratio D2: about 0%). Further, the adhesive portion 70 was formed on the lateral surface part 13*a* on the opposite side from the second slit 50 with respect to the first slit 40.

For the packaging bag 100, the durability, the openability, the take-out property, and the storability were evaluated. The results are shown in Table 1.

Example 2

The packaging bag 100 of the second embodiment illustrated in FIG. 9 was prepared. In the packaging bag 100, except that the length L1 of the first slit 40 was set to about 160 mm (ratio L1: about 70%), the second slit 50 had a base portion 51 and a sloped portion 52 in which one end of the second slit 50 is inclined with respect to the base portion 51, and the third slit 60 had a base portion 61 and a sloped portion 62 in which one end of the third slit 60 is inclined with respect to the base portion 61, the packaging bag 100 was produced and evaluated similarly to Example 1. The results are shown in Table 1.

Example 3

The packaging bag 100 of the third embodiment illustrated in FIG. 10 was prepared. In the packaging bag 100, except that the length L3 of the third slit 60 was set to be shorter than the length L2 of the second slit 50, the length L2 of the second slit 50 was set to about 66 mm (ratio L2: 60%), and the length L3 of the third slit 60 was set to about 33 mm (ratio L3: about 300), the packaging bag 100 was produced and evaluated similarly to Example 1. The results are shown in Table 1.

Example 4

The packaging bag 100 of the fourth embodiment illustrated in FIG. 11 was prepared. In the packaging bag 100, except that in the vertical direction (Z direction), the distance D2 between the third slit 60 and the bottom surface part 12 was set to be longer than the distance D1 between the second slit 50 and the top surface part 11, the distance D1 was set to about 0 mm (ratio D1: about 00), and the distance D2 was set to about 23 mm (ratio D2: about 10%), the packaging bag 100 was produced and evaluated similarly to Example 1. The results are shown in Table 1.

Example 5

The packaging bag 100 of the fifth embodiment illustrated in FIG. 12 was prepared. In the packaging bag 100, except that the curved portion 41 protruding to the opposite side from the second slit 50 with respect to the first slit 40 (region of the lateral surface part 13*a* in which the second slit 50 is not provided) was formed at the center part 40*c* of the first slit 40, the packaging bag 100 was produced and evaluated similarly to Example 2. The results are shown in Table 1.

Example 6

The packaging bag 100 according to the modification of the sixth embodiment illustrated in FIG. 14 was prepared. In the packaging bag 100, except that the fourth slit 80 which is continuous with the center part 40*c* of the first slit 40, faces the second slit 50 in the vertical direction (Z direction), and extends in the traverse direction (X direction) was formed on the lateral surface part 13*a* of the body 10, and the length L4 of the fourth slit 80 was set to about 66 mm (ratio L4: about 60%), the packaging bag 100 was produced and evaluated similarly to Example 1. The results are shown in Table 1.

Comparative Example 1

Except that a linear slit 90 for opening was formed in the vertical direction (Z direction) of the lateral surface part 13*a* as illustrated in FIG. 19 instead of the first slit 40, the second slit 50, and the third slit 60, a packaging bag 100 was produced and evaluated similarly to Example 1. The results are shown in Table 1.

Comparative Example 2

Except that a slit 91 is provided on the top surface part 11, slits 92 and 93 are provided on the lateral surface part 13*a*, and a slit 94 is provided on one lateral surface part 14*a* of the second lateral surface parts 14 as a slit 90 for opening as illustrated in FIG. 20 instead of the first slit 40, the second slit 50, and the third slit 60, a packaging bag 100 was produced and evaluated similarly to Example 1. The results are shown in Table 1.

Comparative Example 3

Except that slits 91, 92, and 93 are provided on the lateral surface part 13*a* near the top surface part 11 as a slit 90 for opening as illustrated in FIG. 21 instead of the first slit 40, the second slit 50, and the third slit 60, a packaging bag 100 was produced and evaluated similarly to Example 1. The results are shown in Table 1.

TABLE 1

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Durability | ○ | ○ | ○ | ○ | ○ | ○ | ○ | X | ○ |
| Openability | 4.8 | 5 | 4.8 | 4.8 | 5 | 4.8 | 4 | 4.2 | 4.8 |
| Take-out property | 4.8 | 4.8 | 5 | 4.6 | 5 | 5 | 2.2 | 3.0 | 1.6 |
| Storability | ○ | ○ | ○ | ○ | ○ | ○ | ○ | ○ | X |

From Table 1, in all the packaging bags 100 in which the first slit 40, the second slit 50, and the third slit 60 are provided on the lateral surface part 13*a* of the body 10, the durability was excellent, the openability was 3.0 or more, the take-out property was 3.5 or more, and the storability was excellent (Examples 1 to 6).

On the other hand, in the packaging bags 100 in which the first slit 40, the second slit 50, and the third slit 60 were not provided, even though the openability was 3.0 or more, the durability was poor, the take-out property was less than 3.5, or the storability was poor in one of the packaging bags 100 (Comparative Examples 1 to 3).

From these results, it was found that when the slash part provided on at least one of the plurality of lateral surface parts of the body has the first slit extending in the vertical direction from near the top surface part to near the bottom surface part, and the second slit extending in the traverse direction intersecting the vertical direction continuously with one end of the first slit on the top surface part side, it is possible to obtain the packaging bag excellent in the openability, the take-out property, and the storability.

Even though the embodiments of the invention have been described above, the invention is not limited to the specific embodiments, and various modifications and changes are possible within the scope of the invention described in the claims.

Hereinafter, preferred aspects of the invention will be additionally described.

A first aspect of the invention is a packaging bag including a body for storing a plurality of articles to be packaged, in which the body has a top surface part, a bottom surface part facing the top surface part in a vertical direction, and a plurality of lateral surface parts disposed between the top surface part and the bottom surface part, a slash part for opening is provided on at least one of the plurality of lateral surface parts, and the slash part includes a first slit extending in the vertical direction from near the top surface part to near the bottom surface part, and a second slit extending in a traverse direction intersecting the vertical direction continuously with one end of the first slit on a side of the top surface part.

In the first aspect, the slash part for opening provided on the lateral surface part of the body of the packaging bag includes the first slit extending over substantially the entire region of the lateral surface part of the body of the packaging bag in the vertical direction, and the second slit continuously extending in the traverse direction from one end of the first slit on the top surface part side. According to such a configuration, in the first aspect, the L-shaped or claw-shaped (hereinafter referred to as L-shaped) slash part is disposed at a conspicuous position on the lateral surface part of the body of the packaging bag, and thus it is easy to find a place to open the packaging bag.

In addition, in the first aspect, when the packaging bag is opened, the first slit is broken in the vertical direction with a small force, and the second slit on the top surface part side is further broken in the traverse direction continuously with the first slit. In this way, a triangular opening hole can be formed on the lateral surface part of the body. Therefore, according to the first aspect, it is possible to provide a packaging bag having excellent openability.

In addition, in the first aspect, since the length of the first slit is a length from near the top surface part to near the bottom surface part in the vertical direction, the length in the vertical direction (length of the broken first slit) becomes approximately the same as the height of the articles to be packaged in a state of being stored in the packaging bag. In addition, as described above, in the triangular opening hole formed on the lateral surface part of the body, the width of the opening hole in the traverse direction gradually widens from the bottom surface part side to the top surface part side. For this reason, in the first aspect, it is easy to take out the articles to be packaged stored in the packaging bag from the opening hole. Therefore, according to the first aspect, it is possible to provide the packaging bag excellent in the product take-out property.

In addition, in the first aspect, as described above, the triangular opening hole is formed on the lateral surface part of the body, so that a broken piece of the packaging bag (part of the lateral surface part of the body formed (or turned up) by breaking the slash part) has a triangular shape corresponding to the shape of the opening hole. For this reason, by covering the lateral surface part (outer periphery of the packaging bag) of the body of the packaging bag with the triangular broken piece after taking out some of the articles to be packaged, it is possible to close (or block) the opening hole. In this way, after opening the packaging bag, the product can be protected from dirt and dust (dirt, dust, mote, etc.). Therefore, according to the first aspect, it is possible to provide the packaging bag excellent in the storability after opening.

Further, in the first aspect, as described above, in the triangular opening hole formed on the lateral surface part of the body, the width of the opening hole in the traverse direction is gradually narrowed from the top surface part side toward the bottom surface part side. In this way, an area for pressing the articles to be packaged of the parts of the lateral surface part adjacent to the opening hole formed after the packaging bag is opened in the traverse direction gradually increases from the top surface part side to the bottom surface part side. Therefore, according to the first aspect, it is possible to prevent the articles to be packaged from coming off from the opening hole after the packaging bag is opened.

In addition, as in the first aspect, in the configuration in which the second slit continuous with one end of the first slit on the top surface part side extends in the traverse direction intersecting the vertical direction, one end of the second slit connected to the one end of the first slit on the top surface part side may be curved or inclined.

By adopting such a configuration, in the first aspect, when the packaging bag is opened, the force in the vertical direction for breaking the first slit is easily transmitted in the traverse direction in which the second slit is broken. For this reason, even when the second slit is formed on the top surface part side of the first slit, the packaging bag can be opened with a smaller force. Further, when the slash part breaks from the first slit to the second slit, it is possible to prevent the slash part from breaking in an unexpected direction.

A second aspect of the invention is the packaging bag in which the first slit is formed along a boundary between at least two adjacent articles to be packaged among the plurality of articles to be packaged. In the second aspect, in the lateral surface part coming into contact with the two adjacent articles to be packaged in the state of being stored in the packaging bag, the first slit can be formed along the boundary between the two articles to be packaged. For this reason, when the packaging bag is opened, a finger is easily caught in the first slit, and the first slit is easily broken. In addition, an end portion of the broken piece formed when the first slit is broken becomes easy to grab, and the second slit is easily broken. Therefore, according to the second aspect, it is possible to provide the packaging bag more excellent in the openability.

A third aspect of the invention is the packaging bag in which a length of the second slit is the same as or shorter than a width of one of the articles to be packaged in the traverse direction. In the third aspect, by setting the length of the second slit to be the same as or shorter than the width of the article to be packaged in the state of being stored in the packaging bag in the traverse direction, the width of the opening hole formed after opening the packaging bag on the top surface part side becomes less than or equal to the width of the article to be packaged in the state of being stored in the packaging bag in the traverse direction. In this way, while ensuring a region in the opening hole for taking out the articles to be packaged, it is possible to press the articles to be packaged by parts of the lateral surface part adjacent to the opening hole in the traverse direction. Therefore, according to the third aspect, it is possible to further prevent the articles to be packaged from coming off from the opening hole after the packaging bag is opened.

A fourth aspect of the invention is the packaging bag in which the slash part further includes a third slit which is continuous with the other end of the first slit on a side of the bottom surface part, faces the second slit in the vertical direction, and extends in the traverse direction. In the fourth aspect, the slash part for opening provided on the lateral surface part of the body of the packaging bag includes the first slit and the second slit as described above, and further includes the third slit continuously extending in the traverse direction from the other end of the first slit on the bottom surface part side. According to such a configuration, in the fourth aspect, since a U-shaped slash part is disposed at a conspicuous position on the lateral surface part of the body of the packaging bag, it is easy to find a place to open the packaging bag.

In addition, in the fourth aspect, when the packaging bag is opened, as described above, the first slit is broken, and the second slit on the top surface part side and the third slit on the bottom surface part side are further broken continuously with the first slit in the traverse direction. In this way, a rectangular opening hole can be formed on the lateral surface part of the body. Therefore, according to the fourth aspect, it is possible to provide the packaging bag having excellent openability.

In addition, in the fourth aspect, since the length of the first slit is a length from near the top surface part to near the bottom surface part in the vertical direction, as described above, the length of the rectangular opening hole formed on the lateral surface part of the body in the vertical direction also becomes approximately the same as the height of the article to be packaged in the state of being stored in the packaging bag. For this reason, it is easy to take out the articles to be packaged stored in the packaging bag. Therefore, according to the fourth aspect, it is possible to provide the packaging bag having the excellent product take-out property.

In addition, in the fourth aspect, as described above, by forming the rectangular opening hole on the lateral surface part of the body, the broken piece of the packaging bag has a rectangular shape corresponding to the shape of the opening hole. For this reason, by covering the lateral surface part of the body of the packaging bag (the outer periphery of the packaging bag) with the rectangular broken piece after taking out some of the articles to be packaged, it is possible to close (or block) the opening hole. In this way, even after opening the packaging bag, the product can be protected from dirt and dust. Therefore, according to the fourth aspect, it is possible to provide the packaging bag excellent in the storability after opening.

Furthermore, in the fourth aspect, the length of the first slit is the length from near the top surface part to near the bottom surface part in the vertical direction as described above, and therefore the length of the first slit becomes shorter than the length of the articles to be packaged in the state of being stored in the packaging bag in the vertical direction. In this way, both end portions of the article to be packaged in the vertical direction can be pressed by parts of the lateral surface part adjacent to an upper end and a lower end of the opening hole formed after opening the packaging bag. Therefore, according to the fourth aspect, it is possible to prevent the article to be packaged from coming off from the opening hole after the packaging bag is opened.

In addition, as in the fourth aspect, in a configuration in which the third slit continuous with one end of the first slit on the bottom surface part side extends in the traverse direction intersecting the vertical direction, one end of the third slit connected to one end of the first slit on the top surface part side may be curved or inclined.

By adopting such a configuration for the third slit, in the fourth aspect, when the packaging bag is opened, the force in the vertical direction for breaking the first slit is easily transmitted in the traverse direction in which the third slit is broken. For this reason, even when the third slit is further formed on the bottom surface part side of the first slit, the packaging bag can be opened with a smaller force. Further, when the slash part breaks from the first slit to the third slit, it is possible to prevent the slash part from breaking in an unexpected direction.

A fifth aspect of the invention is the packaging bag in which a length of the third slit is the same as or shorter than the width of the one of the articles to be packaged in the traverse direction. In the fifth aspect, by setting the length of each of the second slit and the third slit to be the same as or shorter than the width of the article to be packaged in the state of being stored in the packaging bag in the traverse direction, the width of the formed rectangular opening hole in the traverse direction becomes less than or equal to the width of the article to be packaged in the state of being stored in the packaging bag in the traverse direction. In this way, while ensuring a sufficient region in the opening hole for taking out the articles to be packaged, it is possible to press both end portions of the articles to be packaged in the vertical direction by parts of the lateral surface part adjacent to the upper end and the lower end of the rectangular opening hole formed after opening the packaging bag and parts of the lateral surface part adjacent to both end portions in the traverse direction. Therefore, according to the fifth aspect, it is possible to improve the take-out property of the articles to be packaged while preventing the articles to be packaged from coming off from the opening hole.

A sixth aspect of the invention is the packaging bag in which the length of the third slit is shorter than the length of the second slit. In the sixth aspect, by setting the length of the third slit provided on the bottom surface part side to be shorter than the length of the second slit provided on the top surface part side, the width of the opening hole in the traverse direction gradually decreases from the top surface part side to the bottom surface part side. In this way, a trapezoidal opening hole in which the bottom surface part side is an upper bottom and the top surface part side is a lower bottom can be formed on the lateral surface part of the body. In such a trapezoidal opening hole, while ensuring a sufficient region in the opening hole for taking out the articles to be packaged, both end portions of the articles to be packaged in the traverse direction can be pressed by parts of the lateral surface part adjacent to both end portions of the trapezoidal opening hole formed after opening the packaging bag in the traverse direction. Therefore, according to the sixth aspect, it is possible to further improve the take-out property of the articles to be packaged while preventing the articles to be packaged from coming off from the opening hole.

A seventh aspect of the invention is the packaging bag in which a distance between the third slit and the bottom surface part in the vertical direction is longer than a distance between the second slit and the top surface part in the vertical direction. In the seventh aspect, by setting the distance between the third slit and the bottom surface part in the vertical direction to be longer than the distance between the second slit and the top surface part in the vertical direction, it is possible to forma wall portion for pressing the articles to be packaged in a part of the lateral surface part adjacent to an end portion of the opening hole on the bottom surface part side. In this way, it is possible to further prevent the articles to be packaged from coming off from the opening hole formed when the packaging bag is opened.

An eighth aspect of the invention is the packaging bag in which a curved portion protruding to an opposite side from the second slit with respect to the first slit is formed at a center part of the first slit. In the eighth aspect, by providing such a curve portion at the center part of the first slit, the finger is easily caught in the center part of the first slit, and the first slit can be easily broken. In addition, when a broken piece is formed at the center part of the first slit to correspond to the curved portion after the first slit is broken, and a part of the broken piece corresponding to the curved portion is grabbed, it is possible to easily break the second slit and/or the third slit. Therefore, according to the eighth aspect, it is possible to further improve the openability of the packaging bag.

A ninth aspect of the invention is the packaging bag in which the slash part further includes a fourth slit which is continuous with a center part of the first slit, faces the second slit in the vertical direction, and extends in the traverse direction. In the ninth aspect, in the slash part for opening provided in the lateral surface part of the body of the packaging bag, further, the fourth slit continuous with the center part of the first slit extends in the traverse direction by facing the second slit in the vertical direction.

In the ninth aspect, by further breaking a part of the first slit on the top surface part side, the second slit, and the fourth slit, it is possible to form an opening hole having a length that is half a height of the body on the top surface part side. In this way, even when the articles to be packaged are stored in a plurality of stages (for example, three stages) like toilet rolls, etc., it is possible to prevent the remaining articles to be packaged from coming off from the opening hole after the article to be packaged on the upmost stage is taken out.

Further, in the ninth aspect, by breaking the remaining part of the first slit on the bottom surface part and the third slit, an opening hole having a length that is approximately half the height of the body can be further formed on the bottom surface part side. In this way, in the case of taking out the article to be packaged on a lower stage of the article to be packaged on an uppermost stage, it is possible to reliably take out the article to be packaged on the lower stage by breaking the remaining part of the first slit on the bottom surface part side and the third slit.

A tenth aspect of the invention is the packaging bag in which an adhesive portion is provided on the lateral surface part on an opposite side from the second slit with respect to the first slit. In the tenth aspect, by providing such an adhesive portion on the lateral surface part of the body of the packaging bag, it is possible to attach the broken piece of the packaging bag to the adhesive portion when the outer periphery of the body of the packaging bag is covered with the broken piece of the packaging bag after taking out some of the articles to be packaged from the packaging bag. In this way, the packaging bag after opening can be hermetically sealed, and the remaining articles to be packaged stored in the packaging bag can be bundled. Therefore, according to the tenth aspect, the storability after opening the packaging bag can be improved.

This application claims the priority based on Japanese Patent Application No. 2018-61348 filed on Mar. 28, 2018, and the entire contents thereof are incorporated herein.

The invention claimed is:

1. A packaging bag comprising:

a body storing a plurality of articles, wherein the body has a top surface part, a bottom surface part facing the top surface part in a vertical direction, and a plurality of lateral surface parts disposed between the top surface part and the bottom surface part, a slash part for opening is provided on at least one of the plurality of lateral surface parts, and the slash part further comprises a first slit extending in the vertical direction from near the top surface part to near the bottom surface part wherein the first slit is formed along a boundary between at least two adjacent articles packaged among the plurality of articles to be packaged, and a second slit extending in a traverse direction intersecting the vertical direction continuously with one end of the first slit on a side of the top surface part wherein a length of the second slit is the same as or shorter than a width of one of the articles packaged in the traverse direction.

2. The packaging bag according to claim 1, wherein the slash part further comprises a third slit which is continuous with the other end of the first slit on a side of the bottom surface part, faces the second slit in the vertical direction, and extends in the traverse direction.

3. The packaging bag according to claim 2, wherein a length of the third slit is the same as or shorter than the width of the one of the articles to be packaged in the traverse direction.

4. The packaging bag according to claim 2, wherein the length of the third slit is shorter than the length of the second slit.

5. The packaging bag according to claim 2, wherein a distance between the third slit and the bottom surface part in the vertical direction is longer than a distance between the second slit and the top surface part in the vertical direction.

6. The packaging bag according to claim 1, wherein a curved portion protruding to an opposite side from the second slit with respect to the first slit is formed at a center part of the first slit.

7. The packaging bag according to claim 1, wherein the slash part further comprises a fourth slit which is continuous with a center part of the first slit, faces the second slit in the vertical direction, and extends in the traverse direction.

8. The packaging bag according to claim 1, wherein an adhesive portion is provided on the lateral surface part on an opposite side from the second slit with respect to the first slit.

9. The packaging bag according to claim 1, wherein the slash part further comprises a third slit which is continuous with the other end of the first slit on a side of the bottom surface part, faces the second slit in the vertical direction, and extends in the traverse direction.

10. The packaging bag according to claim 1, wherein the slash part further comprises a third slit which is continuous with the other end of the first slit on a side of the bottom surface part, faces the second slit in the vertical direction, and extends in the traverse direction.

11. The packaging bag according to claim 3, wherein a distance between the third slit and the bottom surface part in the vertical direction is longer than a distance between the second slit and the top surface part in the vertical direction.

12. The packaging bag according to claim 4, wherein a distance between the third slit and the bottom surface part in the vertical direction is longer than a distance between the second slit and the top surface part in the vertical direction.

13. The packaging bag according to claim 1, wherein a curved portion protruding to an opposite side from the second slit with respect to the first slit is formed at a center part of the first slit.

14. The packaging bag according to claim 1, wherein a curved portion protruding to an opposite side from the second slit with respect to the first slit is formed at a center part of the first slit.

15. The packaging bag according to claim 2, wherein a curved portion protruding to an opposite side from the second slit with respect to the first slit is formed at a center part of the first slit.

16. The packaging bag according to claim 3, wherein a curved portion protruding to an opposite side from the second slit with respect to the first slit is formed at a center part of the first slit.

17. The packaging bag according to claim 4, wherein a curved portion protruding to an opposite side from the second slit with respect to the first slit is formed at a center part of the first slit.

18. The packaging bag according to claim 5, wherein a curved portion protruding to an opposite side from the second slit with respect to the first slit is formed at a center part of the first slit.

* * * * *